US011455961B2

(12) United States Patent
Shimoda et al.

(10) Patent No.: US 11,455,961 B2
(45) Date of Patent: Sep. 27, 2022

(54) DISPLAY DEVICE

(71) Applicant: Wuhan Tianma Micro-Electronics Co., Ltd., Wuhan (CN)

(72) Inventors: Masamichi Shimoda, Kanagawa (JP); Jiro Yanase, Kanagawa (JP); Yojiro Matsueda, Kanagawa (JP)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/544,503

(22) Filed: Dec. 7, 2021

(65) Prior Publication Data

US 2022/0208122 A1 Jun. 30, 2022

(30) Foreign Application Priority Data

Dec. 28, 2020 (JP) ..... JP2020-218509
Oct. 21, 2021 (JP) ..... JP2021-172300

(51) Int. Cl.
*G09G 3/3291* (2016.01)

(52) U.S. Cl.
CPC ..... *G09G 3/3291* (2013.01); *G09G 2320/045* (2013.01)

(58) Field of Classification Search
CPC .. G09G 3/3233; G09G 3/3266; G09G 3/3258; G09G 3/30; G09G 3/3225; G09G 3/20; G09G 2300/0819; G09G 2300/0866; G09G 2300/0426; G09G 2320/043; G09G 2320/0233; G09G 2320/045; G09G 2310/08
See application file for complete search history.

(56) References Cited

U.S. PATENT DOCUMENTS

| | | | | |
|---|---|---|---|---|
| 9,576,527 | B2 * | 2/2017 | Han | G09G 3/003 |
| 2005/0200618 | A1 | 9/2005 | Kim et al. | |
| 2014/0062331 | A1 * | 3/2014 | Nam | G09G 3/3233 315/226 |
| 2016/0133187 | A1 * | 5/2016 | Li | G09G 3/3233 345/77 |
| 2019/0130843 | A1 * | 5/2019 | Yu | G09G 3/3233 |
| 2019/0147798 | A1 * | 5/2019 | Hwang | G09G 3/3266 345/691 |
| 2019/0156751 | A1 | 5/2019 | Zhang | |

* cited by examiner

*Primary Examiner* — Dong Hui Liang
(74) *Attorney, Agent, or Firm* — Nixon & Vanderhye

(57) ABSTRACT

A driver is configured to maintain a threshold compensation transistor to be ON to write a threshold compensation voltage to a storage capacitor in a threshold compensation period, and write a data signal to the storage capacitor in a data write period after the threshold compensation period. A pulse width of control signal is twice or more as long as the data write period. The driver circuit is configured to turn ON a first transistor with a start edge of a first control signal pulse before the data write period starts, maintain the first transistor to be ON and turn ON a second transistor with a start edge of a second control signal pulse to start the data write period, and turn OFF the first transistor with an end edge of the first control signal pulse to end the data write period.

13 Claims, 22 Drawing Sheets

DISPLAY DEVICE

CROSS-REFERENCE TO RELATED APPLICATIONS

This non-provisional application claims priority under 35 U.S.C. § 119(a) on Patent Application No. 2020-218509 filed in Japan on Dec. 28, 2020 and Patent Application No. 2021-172300 filed in Japan on Oct. 21, 2021, the entire contents of which are hereby incorporated by reference.

BACKGROUND

This disclosure relates to a display device.

An organic light-emitting diode (OLED) element is a current-driven self-light-emitting element and therefore, does not need a backlight. In addition to this, the OLED element has advantages for achievement of low power consumption, wide viewing angle, and high contrast ratio; it is expected to contribute to development of flat panel display devices.

An active-matrix (AM) OLED display device includes transistors for selecting pixels and driving transistors for supplying electric current to the pixels. The transistors in an OLED display device are thin-film transistors (TFTs); commonly, low-temperature polysilicon (LTPS) TFTs are used.

The TFTs have variations in their threshold voltage and charge mobility. Since the driving transistors determine the light emission intensity of the OLED display device, their variations in electrical characteristics could cause a problem. Hence, a typical OLED display device includes a correction circuit for compensating for the variations and shifts of the threshold voltage of the driving transistors.

An OLED display device could show a ghost image and this phenomenon is called image retention. For example, in displaying a full-screen image of an intermediate emission level after displaying a black and white checkerboard pattern for a specific period, the OLED display device displays a ghost image of the checkerboard pattern of different emission levels for a while.

This is caused by hysteresis effect of the driving transistors. The hysteresis effect causes a phenomenon in a field-effect transistor such that the drain current flows differently between the case where the gate-source voltage changes from a high voltage to a low voltage and the case where the gate-source voltage changes from the low voltage to the high voltage.

That is to say, the drain current flows differently between the pixels whose emission level is changed from the black level to an intermediate level and the pixels whose emission level is changed from the white level to the intermediate level. For this reason, the OLED display device emits different intensities of light. This difference in drain current continues over several frames and therefore, the difference in intensity of emitted light is perceived as a ghost.

SUMMARY

A display device according to an aspect of this disclosure includes: a display region including a plurality of pixel circuit rows; and a driver circuit. Each of the plurality of pixel circuit rows includes a plurality of pixel circuits. Each of the plurality of pixel circuits includes: a driving transistor configured to control an amount of electric current to a light-emitting element; a storage capacitor configured to hold a control voltage for the driving transistor; a first transistor and a second transistor connected in series, the first and the second transistors being configured to transmit a data signal to the storage capacitor; and a threshold compensation transistor configured to write a threshold compensation voltage for the driving transistor to the storage capacitor. The driver circuit is configured to shift control signal pulses from a row to a next row in the plurality of pixel circuit rows every time a predetermined period passes. A pulse width of the control signal pulses is twice or more as long as the predetermined period. The driver circuit is configured to: maintain the threshold compensation transistor to be ON to write a threshold compensation voltage to the storage capacitor in a threshold compensation period; and maintain the threshold compensation transistor to be OFF and the first transistor and the second transistor to be ON to write a data signal to the storage capacitor in a data write period subsequent to the threshold compensation period. A pulse width of the control signal pulses is twice or more as long as the data write period. The driver circuit is configured to: control the first transistor with a first control signal pulse; control the second transistor with a second control signal pulse different from the first control signal pulse; turn ON the first transistor with a start edge of the first control signal pulse before the data write period starts; maintain the first transistor to be ON and turn ON the second transistor with a start edge of the second control signal pulse to start the data write period after the threshold compensation period ends; and turn OFF the first transistor with an end edge of the first control signal pulse to end the data write period.

It is to be understood that both the foregoing general description and the following detailed description are exemplary and explanatory and are not restrictive of this disclosure.

EMBODIMENTS

Figure 1:
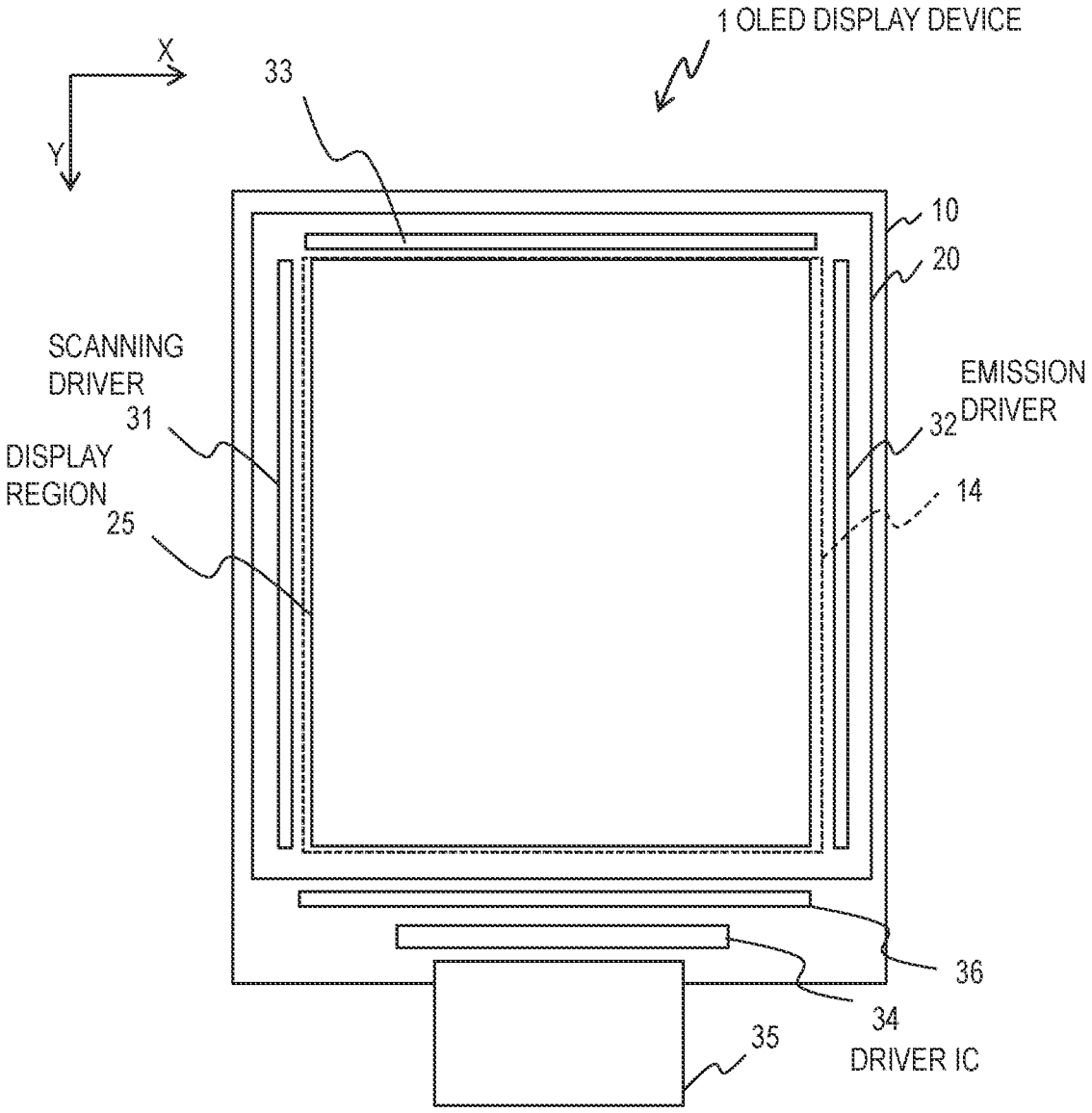
FIG. 1 schematically illustrates a configuration example of an OLED display device.

Hereinafter, embodiments will be described with reference to the accompanying drawings. Elements common to the drawings are denoted by the same reference signs and each element in the drawings may be exaggerated in size and/or shape for clear understanding of the description.

Disclosed hereinafter are techniques to improve the control of driving current to light light-emitting elements in a light-emitting type of display device such as an organic light emitting diode (OLED) display device. More specifically, disclosed are techniques to improve the display quality by appropriately compensating the threshold of a driving transistor in each pixel circuit with fewer control signals.

For example, image retention depends on the characteristics of transient response of the current by hysteresis effect of the driving transistors and the characteristics of threshold voltage compensation for the driving transistors performed by pixel circuits. Regardless of image retention, the image quality could be degraded when the threshold voltage compensation for the driving TFTs is insufficient, A display device in an embodiment of this specification writes a data signal to a storage capacitor in a pixel circuit after writing a voltage for compensating the threshold of a driving transistor to the storage capacitor. The pixel circuit includes switch transistors connected in series to transmit the data signal to the storage capacitor. The display device controls these switch transistors with different control signal pulses. The pulse widths of these control signal pulses are twice or more as long as a data write period and their phases (the times of their edges) are different. Controlling the switch transistors connected in series with control signal pulses of different phases for a predetermined period enables effective threshold compensation of driving transistors with fewer control signals.

Configuration of Display Device

Hereinafter, embodiments of this specification are described more specifically. FIG. 1 schematically illustrates a configuration example of an OLED display device 1. The OLED display device 1 includes a thin-film transistor (TFT) substrate 10 on which organic light-emitting elements (OLED elements) and pixel circuits are fabricated and a thin-film encapsulation (TFE) 20 for encapsulating the OLED elements. The thin-film encapsulation 20 is an example of a structural encapsulation unit. Another example of the structural encapsulation unit can include an encapsulation substrate for encapsulating the OLED elements and a bond (glass frit sealer) for bonding the TFT substrate 10 and the encapsulation substrate. The space between the TFT substrate 10 and the encapsulation substrate is filled with dry air or nitrogen, for example.

In the periphery of a cathode electrode region 14 outer than the display region 25 of the TFT substrate 10, a scanning driver 31, an emission driver 32, a protection circuit 33, a driver IC 34, and a demultiplexer 36 are provided. The driver IC 34 is connected to the external devices via flexible printed circuits (FPC) 35. These circuits are included in a control circuit for controlling the OLED display device 1. One or more of these circuits can be optional.

The scanning driver 31 drives scanning lines on the TFT substrate 10. The emission driver 32 drives emission control lines to control the light emission periods of pixels. As will be described later, the emission driver 32 can drive the scanning lines for threshold compensation of the driving transistors or data write, in addition to the emission control lines. For this reason, the scanning driver 31 can be referred to as first scanning driver and the emission driver 32 as second scanning driver. The emission control lines are used to select pixel circuit rows one by one and therefore, they are also scanning lines. The scanning lines and the emission control lines are control lines for controlling the pixel circuits.

The scanning driver 31 and the emission driver 32 are included in a driver circuit for driving the pixel circuits. A circuit for outputting control signals equivalent to the control signals from the scanning driver 31 and the emission driver 32 can be disposed on only one side of the display region 25.

The scanning driver 31 and the emission driver 32 are disposed on the opposite sides across the display region 25. The scanning lines and the emission control lines are disposed to extend horizontally and aligned vertically in FIG. 1. The driver IC 34 is mounted with an anisotropic conductive film (ACF), for example.

The protection circuit 33 protects the elements in the pixel circuits from electrostatic discharge. The driver IC 34 provides power and timing signals (control signals) to the scanning driver 31 and the emission driver 32 and further, provides power and a data signal to the demultiplexer 36.

The demultiplexer 36 outputs output of one pin of the driver IC 34 to d data lines serially (d is an integer greater than 1). The data lines are disposed to extend vertically and aligned horizontally in FIG. 1. The demultiplexer 36 changes the output data line for the data signal from the driver IC 34 *d* times per scanning period to drive d times as many data lines as output pins of the driver IC 34.

As will be described later, each pixel circuit includes a driving TFT (driving transistor) and a storage capacitor for holding a signal voltage to determine the driving current of the driving TFT. The data signal transmitted by a data line is adjusted depending on the threshold of the driving TFT and stored to the storage capacitor. The voltage of the storage capacitor determines the gate voltage (Vgs) of the driving TFT. The adjusted data signal alters the conductance of the driving TFT in an analog manner to supply a forward bias current corresponding to a light emission level to the OLED element.

Configuration of Pixel Circuit

Figure 2:
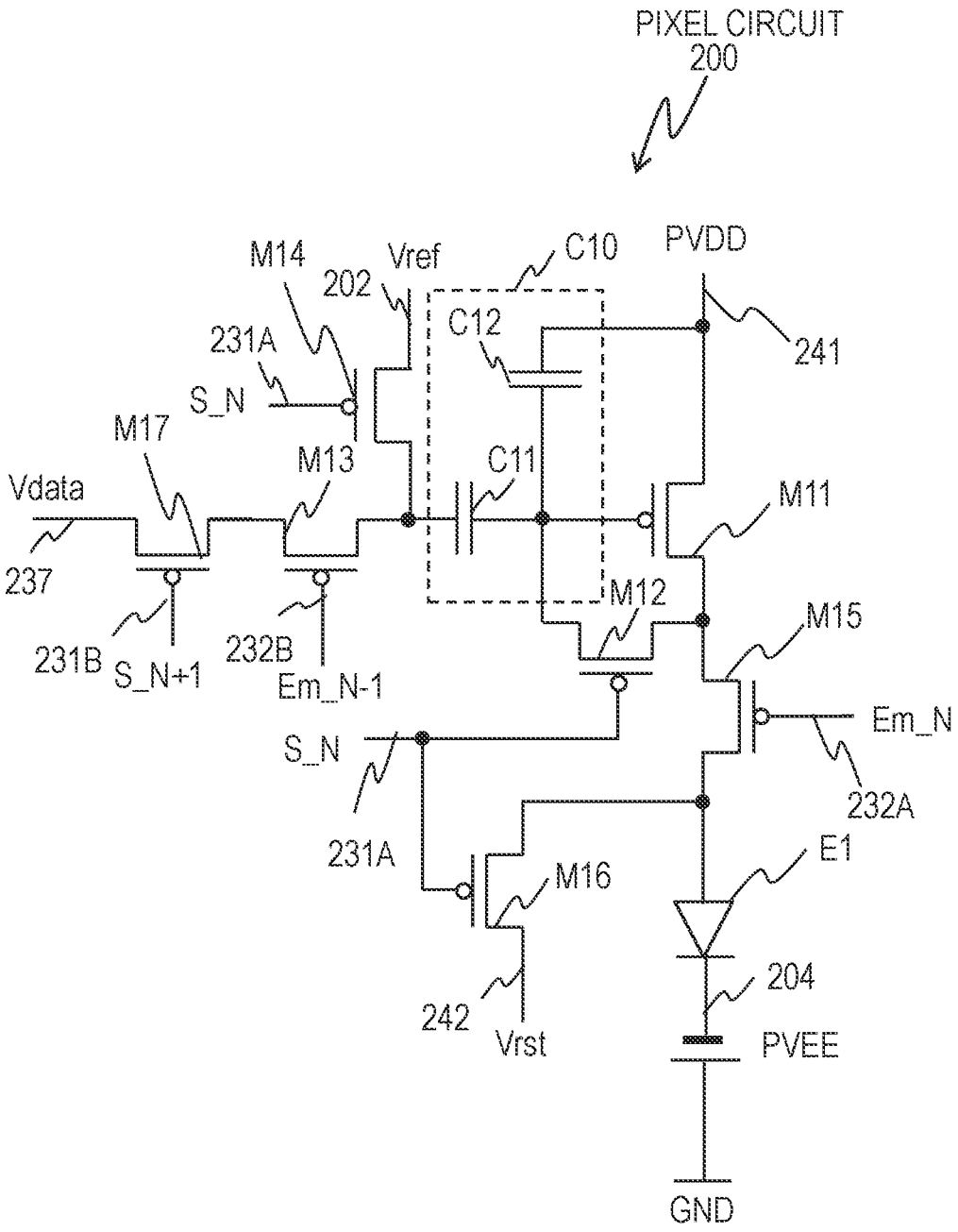
FIG. 2 illustrates a configuration example of a pixel circuit and control signals therefor in an embodiment.

FIG. 2 illustrates a configuration example of a pixel circuit 200 and control signals therefor in an embodiment. The pixel circuit 200 is included in an N-th pixel circuit row (N is an integer). The pixel circuit 200 includes seven transistors (TFTs) M11 to M17 each having a gate, a source, and a drain. All transistors M11 to M17 in this example are p-type TFTs (the polarity of the transistors is of p-type).

The transistor M11 is a driving transistor for controlling the amount of electric current to an OLED element E1. The source of the driving transistor M11 is connected with a power line 241 for transmitting a power supply potential PVDD. The driving transistor M11 controls the amount of electric current to be supplied from the power line 241 to the OLED element E1 in accordance with a voltage stored in a storage capacitor C10. The storage capacitor C10 holds a written voltage throughout one frame period. The cathode of the OLED element E1 is connected with a power line 204 for transmitting a power supply potential PVEE from a cathode power supply.

The storage capacitor C10 in the configuration example of FIG. 2 consists of capacitors C11 and C12 connected in series. One end of the storage capacitor C10 is supplied with the anode power supply potential PVDD and another end is connected with the sources/drains of the switch transistors M13 and M14. Still another end of the storage capacitor C10 is connected with the gate of the driving transistor M11.

More specifically, an end of the capacitor C12 is connected with the power line 241; an end of the capacitor C11 is connected with the sources/drains of the switch transistors M13 and M14; and an intermediate node between the capacitors C11 and C12 is connected with the gate of the driving transistor M11.

The voltage of the storage capacitor C10 is a voltage between the gate of the driving transistor M11 and the anode power line 241. The source of the driving transistor M11 is connected with the anode power line 241; the source potential is the anode power supply potential PVDD. Accordingly, the storage capacitor C10 stores the voltage between the gate and the source of the driving transistor M11. In the configuration example of FIG. 2, the capacitor C12 holds the gate-source voltage of the driving transistor M11.

The transistor M15 is an emission control switch transistor for controlling ON/OFF of supply of driving current to the OLED element E1 and the resulting light emission of the OLED element E1. The source of the transistor M15 is connected with the drain of the driving transistor M11. The transistor M15 switches ON/OFF the current supply to the OLED element E1 connected with its drain. The gate of the transistor M15 is connected with a control signal line 232A and the transistor M15 is controlled by the emission control signal Em_N input from the emission driver 32 to its gate. The emission control signal is a selection signal for controlling light emission of the OLED element E1.

The transistor M16 works to supply a reset potential Vrst to the anode of the OLED element E1. One end of the source/drain of the transistor M16 is connected with a power line 242 for transmitting the reset potential Vrst and the other end is connected with the anode of the OLED element E1.

The gate of the transistor M16 is connected with a control signal line 231A and the transistor M16 is controlled by a control signal S_N. When the transistor M16 is turned ON by the control signal S_N from the scanning driver 31, the transistor M16 supplies the reset potential Vrst transmitted by the power line 242 to the anode of the OLED element E1. The transistors M15 and M16 also supply the reset potential Vrst to the gate of the driving transistor M11 via the transistor M12.

The transistor M12 is a switch transistor (threshold compensation transistor) for writing a voltage for correcting (compensating) the threshold of the driving transistor M11 to the storage capacitor C10 and for resetting the gate potential of the driving transistor M11. The source and the drain of the transistor M12 connect the gate and the drain of the driving transistor M11. Accordingly, when the transistor M12 is ON, the driving transistor M11 is diode connected.

The transistor M14 is a switch transistor (threshold compensation transistor) for writing a voltage for threshold compensation of the driving transistor M11 to the storage capacitor C10. The transistor M14 controls whether to supply a reference potential Vref to the storage capacitor C10. One end of the source/drain of the transistor M14 is connected with a power line 202 for transmitting the reference potential Vref and the other end is connected with an end of the capacitor C11. The gate of the transistor M14 is connected with the control signal line 231A and the transistor M14 is controlled by the selection signal S_N input from the scanning driver 31 to its gate.

The transistors M12, M16, and M14 are controlled by the selection signal S_N. Accordingly, these transistors M12, M16, and M14 are turned ON/OFF simultaneously. During the period while these transistors and the transistor M15 are ON, the gate potential of the driving transistor M11 is reset. Subsequently, the emission control transistor M15 is turned OFF. When the transistors M12 and M14 are ON, the transistor M11 is a diode-connected transistor. A threshold compensation voltage between the power supply potential PVDD and the reference potential Vref is written to the storage capacitor C10.

The transistors M13 and M17 connected in series are switch transistors for selecting a pixel circuit to be supplied with a data signal and writing the data signal (data signal voltage) Vdata to the storage capacitor C10.

One end of the source/drain of the transistor M13 is connected with the storage capacitor C10 and the other end is connected with an end of the source/drain of the transistor M17. More specifically, one end of the source/drain of the transistor M13 is connected with an end of the capacitor C11. The other end of the source/drain of the transistor M17 is connected with a data line 237 for transmitting the data signal Vdata.

The gate of the transistor M13 is connected with a control signal line 232B for transmitting an emission control signal Em_N−1 from the emission driver 32. The transistor M13 is controlled by the emission control signal Em_N−1. Although the emission control signal Em_N−1 is a signal for controlling the light emission of the (N−1)th pixel circuit row, the transistor M13 is not a transistor for controlling the light emission of the OLED element E1 but a switch transistor for controlling supply of the data signal Vdata to the storage capacitor C10.

The gate of the transistor M17 is connected with a control signal line 231B for transmitting a selection signal S_N+1 from the scanning driver 31. The transistor M17 is controlled by the selection signal S_N+1. The selection signal S_N+1 is a signal for selecting the (N+1)th pixel circuit row. The transistor M17 controls supply of the data signal Vdata to the storage capacitor C10.

When the transistors M13 and M17 are ON together, the transistors M13 and M17 supply the data signal Vdata supplied from the driver IC 34 via the data line 237 to the storage capacitor C10. Since the transistors M13 and M17 are controlled by control signals for different pixel circuit rows as described above, the storage capacitor C10 is supplied with the data signal Vdata only in the period where the two control signals S_N+1 and Em_N−1 are both Low.

Figure 3:
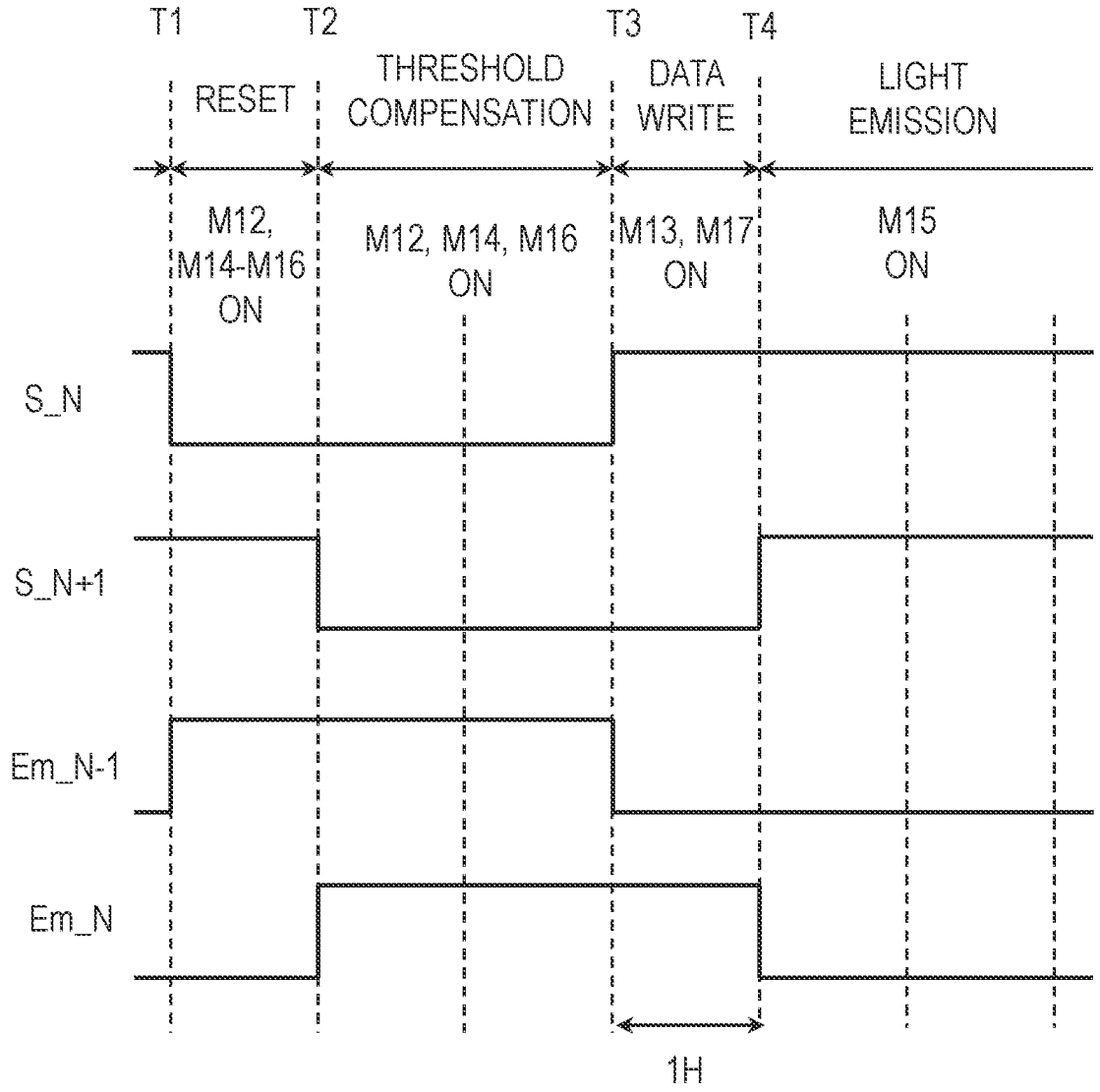
FIG. 3 is an example of the timing chart of the signals for controlling the pixel circuit illustrated in FIG. 2.

FIG. 3 is an example of the timing chart of the signals for controlling the pixel circuit 200 in the N-th pixel circuit row illustrated in FIG. 2 to write a threshold compensation voltage for a driving transistor M11 and a data signal Vdata to the pixel circuit.

Specifically, FIG. 3 illustrates temporal variation in signal potential level in one frame of the selection signals S_N and S_N+1 for selecting the N-th pixel circuit row and the (N+1)th pixel circuit row, respectively, to write the data signal Vdata and the emission control signals Em_N−1 and Em_N for the (N−1)th pixel circuit row and the N-th pixel circuit row, respectively. The selection signal is a kind of control signal and can be referred to as scanning signal.

The period of 1H in the timing chart of FIG. 3 is a period to write a data signal Vdata to the pixel circuit and a period in which the transistors M13 and M17 are ON. A threshold compensation period is not shorter than 1H and in the example of FIG. 3, 2H.

At a time T1, the selection signal S_N+1 is High and the transistor M17 is OFF. The emission control signal Em_N is Low and the transistor M15 is ON.

The selection signal S_N changes from High to Low and the emission control signal Em_N−1 changes from Low to High at the time T1. The transistors M12, M14, and M16 turn from OFF to ON in response to the change of the selection signal S_N. The transistor M13 turns from ON to OFF in response to the change of the emission control signal Em_N−1.

In response to the transistor M16 turning ON, supply of the reset potential Vrst to the anode of the OLED element E1 starts. Since the transistors M12, M15, and M16 are ON, supply of the reset potential Vrst to the gate of the driving transistor M11 starts. This state is maintained from the time T1 to a time T2. The period from the time T1 to the time T2 is a period to reset the anode potential of the OLED element E1 and the gate potential of the driving transistor M11. The period from the time T1 to the time T2 has a length of 1H. In the reset period, the transistors M13 and M17 are OFF.

At the time T2, the selection signal S_N+1 changes from High to Low and further, the emission control signal Em_N changes from Low to High. The transistor M17 turns from OFF to ON in response to the change of the selection signal S_N+1. The transistor M15 turns from ON to OFF in response to the change of the emission control signal Em_N. The supply of the reset potential Vrst to the gate of the driving transistor M11 is stopped by the transistor M15 turning OFF.

At the time T2, the transistors M12, M14, M16, and M17 are ON. The transistors M13 and M15 are OFF. Since the transistors M13 and M15 are OFF and the transistors M12 and M14 are ON, a threshold compensation voltage is written to the storage capacitor C10. Write of the threshold compensation voltage to the storage capacitor C10 starts at the time T2. As described above, the transistor M17 turns from OFF to ON together with the start of the threshold compensation period, in response to the start edge of a pulse of the selection signal S_N+1.

The potential levels of the signals S_N, S_N+1, Em_N−1, and Em_N are maintained from the time T2 to a time T3. At the time T3, the selection signal S_N changes from Low to High. Further, the emission control signal Em_N−1 changes from High to Low.

The transistors M12, M14, and M16 turn from ON to OFF in response to the change of the selection signal S_N. Accordingly, the write of the threshold compensation voltage to the storage capacitor C10 ends at the time T3. The period from the time T2 to the time T3 is a period to write a threshold compensation voltage to the storage capacitor C10 and has a length of 2H in the example of FIG. 3.

In response to the change of the emission control signal Em_N−1 at the time T3, the transistor M13 turns from OFF to ON. Since the transistors M13 and M17 are ON, the data signal Vdata is written to the storage capacitor C10 via the transistors M13 and M17. Write of the data signal Vdata to the storage capacitor C10 starts at the time T3. The potential levels of the signals S_N, S_N+1, Em_N−1, and Em_N are maintained from the time T3 to a time T4. At the time T4, the selection signal S_N+1 changes from Low to High.

In response, the transistor M17 turns from ON to OFF and as a result, the data write to the N-th pixel circuit row ends. The period from the time T3 to the time T4 is a data write period for the N-th pixel circuit row and has a length of 1H. After the time T4, the selection signal S_N+1 is maintained to be High.

The emission control signal Em_N changes from High to Low at the time T4. In response, the transistor M15 turns from OFF to ON. As a result, the driving current is supplied to the OLED element E1 and the OLED element E1 starts emitting light.

Figure 4:
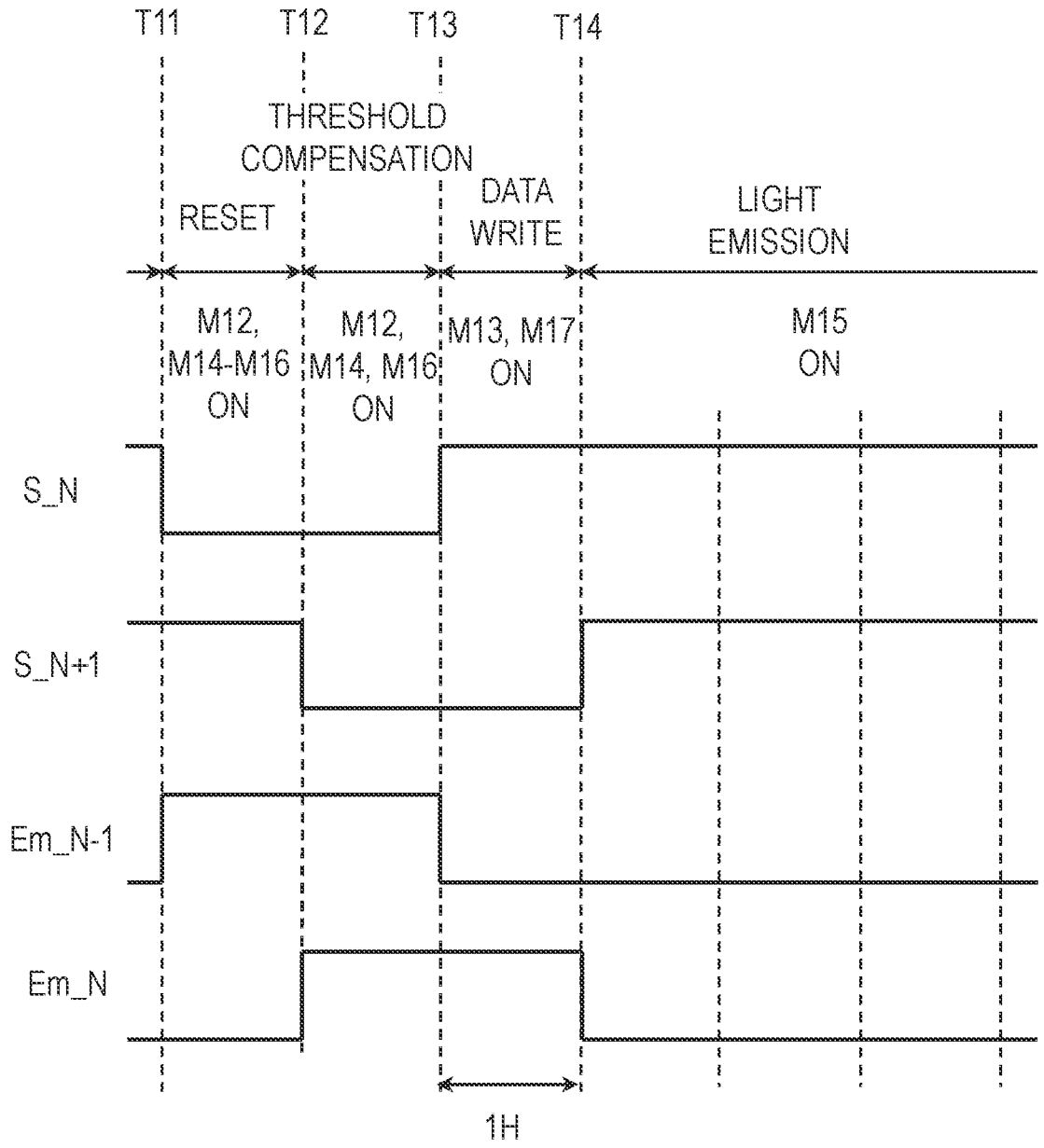
FIG. 4 is another example of the timing chart of the signals for controlling the pixel circuit illustrated in FIG. 2.

FIG. 4 is another example of the timing chart of the signals for controlling the pixel circuit 200 in the N-th pixel circuit row illustrated in FIG. 2 to write a threshold compensation voltage for the driving transistor M11 and a data signal Vdata to the pixel circuit. Specifically, FIG. 4 illustrates temporal variation in signal potential level in one frame of the selection signals S_N and S_N+1 and the emission control signals Em_N−1 and Em_N.

The period of 1H in the timing chart of FIG. 4 is a period to write a data signal Vdata to the pixel circuit and a period in which the transistors M13 and M17 are ON. A threshold compensation period is not shorter than 1H and in the example of FIG. 4, 1H.

At a time T11, the selection signal S_N+1 is High and the transistor M17 is OFF. The emission control signal Em_N is Low and the transistor M15 is ON.

The selection signal S_N changes from High to Low and the emission control signal Em_N−1 changes from Low to High at the time T11. The transistors M12, M14, and M16 turn from OFF to ON in response to the change of the selection signal S_N. The transistor M13 turns from ON to OFF in response to the change of the emission control signal Em_N−1.

In response to the transistor M16 turning ON, supply of the reset potential Vrst to the anode of the OLED element E1 starts. Since the transistors M12, M15, and M16 are ON, supply of the reset potential Vrst to the gate of the driving transistor M11 starts. This state is maintained from the time T11 to a time T12. The period from the time T11 to the time T12 is a period to reset the anode potential of the OLED element E1 and the gate potential of the driving transistor M11. The period from the time T11 to the time T12 has a length of 1H.

At the time T12, the selection signal S_N+1 changes from High to Low and further, the emission control signal Em_N changes from Low to High. The transistor M17 turns from OFF to ON in response to the change of the selection signal S_N+1. The transistor M15 turns from ON to OFF in response to the change of the emission control signal Em_N. The supply of the reset potential Vrst to the gate of the driving transistor M11 is stopped by the transistor M15 turning OFF.

At the time T12, the transistors M12, M14, M16, and M17 are ON. The transistors M13 and M15 are OFF. Since the transistors M13 and M15 are OFF and the transistors M12 and M14 are ON, a threshold compensation voltage is written to the storage capacitor C10. Write of the threshold compensation voltage to the storage capacitor C10 starts at the time T12.

The potential levels of the signals S_N, S_N+1, Em_N−1, and Em_N are maintained from the time T12 to a time T13. At the time T13, the selection signal S_N changes from Low to High. Further, the emission control signal Em_N−1 changes from High to Low.

The transistors M12, M14, and M16 turn from ON to OFF in response to the change of the selection signal S_N. Accordingly, the write of the threshold compensation voltage to the storage capacitor C10 ends at the time T13. The period from the time T12 to the time T13 is a period to write a threshold compensation voltage to the storage capacitor C10 and has a length of 1H in the example of FIG. 4.

In response to the change of the emission control signal Em_N−1 at the time T13, the transistor M13 turns from OFF to ON. Since the transistors M13 and M17 are ON, the data signal Vdata is written to the storage capacitor C10 via the transistors M13 and M17. Write of the data signal Vdata to the storage capacitor C10 starts at the time T13. The potential levels of the signals S_N, S_N+1, Em_N−1, and Em_N are maintained from the time T13 to a time T14.

At the time T14, the selection signal S_N+1 changes from Low to High. In response, the transistor M17 turns from ON to OFF and as a result, the data write to the N-th pixel circuit row ends. The period from the time T13 to the time T14 is a data write period for the N-th pixel circuit row and has a length of 1H. After the time T14, the selection signal S_N+1 is maintained to be High.

The emission control signal Em_N changes from High to Low at the time T14. In response, the transistor M15 turns from OFF to ON. As a result, the driving current is supplied to the OLED element E1 and the OLED element E1 starts emitting light.

In the foregoing examples, the transistors M13 and M17 are controlled by different control signal pulses. Specifically, the transistor M17 is controlled by a pulse of the control signal S_N+1 and the transistor M13 is controlled by a pulse of the control signal Em_N−1.

The transistor M17 (an example of a first transistor) is turned ON by a start edge of a pulse of the control signal S_N+1 at the time T2 or T12 earlier than the time to start a data write period. The transistor M13 (an example of a second transistor) is turned ON by a start edge of a pulse of the control signal Em_N−1 at the time T3 or T13 when to start a data write period. The transistor M17 is turned OFF by an end edge of a pulse of the control signal S_N+1 at the time T4 or T14 when to end the data write period.

In the timing chart of FIG. 4, the control signals have a pulse width of 2H, which is twice as long as a data write period. A threshold compensation period is equal in length to a data write period. In the timing chart of FIG. 3, the control signals have a pulse width of 3H, which is three times as long as a data write period. A threshold compensation period is twice as long as a data write period. The pulse widths of the control signals can be made longer than these examples to provide a longer threshold compensation period.

A threshold compensation period can be provided before a data write period of 1H with fewer control signal pulses by controlling the transistors M13 and M17 with different control signal pulses having a pulse width of 2H or more. Furthermore, a desired length of threshold compensation period can be configured by adjusting the pulse width of the control signals.

Figure 5:
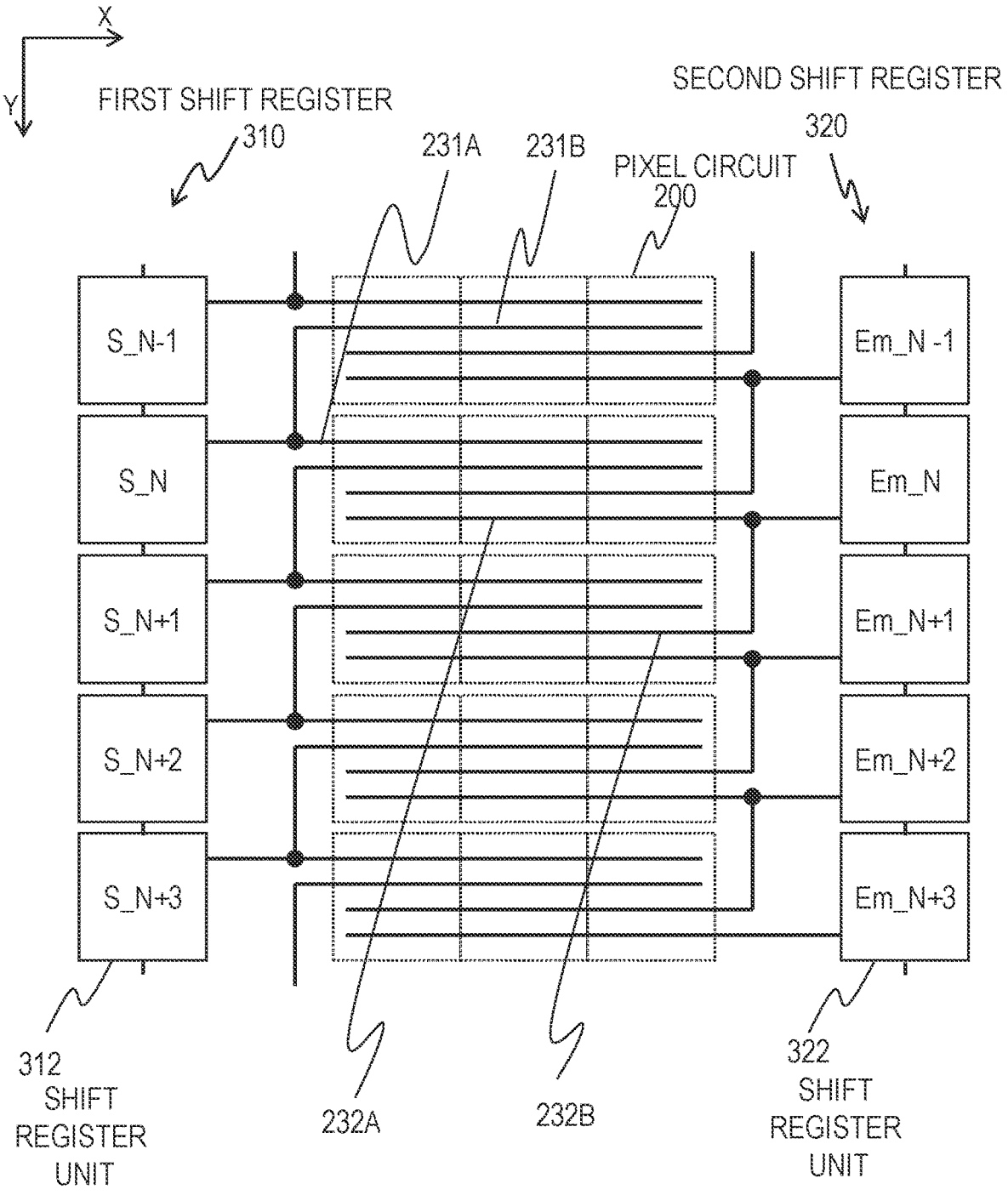
FIG. 5 schematically illustrates a layout of the control signal lines for transmitting control signals to pixel circuits illustrated in FIG. 2.

FIG. 5 schematically illustrates a layout of the control signal lines for transmitting control signals to pixel circuits 200. The display region 25 includes a plurality of pixel circuits 200 for controlling light emission of OLED elements of individual pixels. In FIG. 5, one of the pixel circuits is provided with a reference sign 200 by way of example. In the configuration example of FIG. 5, the pixel circuits 200 are disposed in a matrix. The layout of pixel circuits is not limited to a specific one.

In a full-color OLED display device, each OLED element emits light of one of the colors of red, blue, and green, for example. A plurality of pixel circuits 200 constitute a pixel circuit array. In the configuration example of FIG. 5, one pixel circuit row is composed of a plurality of pixel circuits 200 aligned along the X-axis (horizontally in FIG. 5). One pixel circuit row is controlled by the same control signal lines.

Not-shown data lines are each connected with a pixel circuit column, which is connected with one pixel circuit in each pixel circuit row. Each data line transmits a data signal specifying the intensity of light emission to the pixel circuit in the selected pixel circuit row.

A first shift register 310 is included in the scanning driver 31. The first shift register 310 includes a plurality of shift register units 312 connected in series. The shift register units 312 are flip-flops. In FIG. 5, one of the shift register units is provided with a reference sign 312 by way of example. FIG. 5 includes the (N−1)th to (N+3)th shift register units 312 by way of example. The character string within each shift register unit 312 indicates the control signal output from the shift register unit 312. For example, the shift register unit including the character string S_N outputs a selection signal S_N.

A second shift register 320 is included in the emission driver 32. The second shift register 320 includes a plurality of shift register units 322 connected in series. The shift register units 322 are flip-flops. In FIG. 5, one of the shift register units is provided with a reference sign 322 by way of example. The character string within each shift register unit 322 indicates the control signal output from the shift register unit 322. For example, the shift register unit including the character string Em_N outputs an emission control signal Em_N.

The first shift register 310 drives control signal lines 231A and 231B extending along the X-axis in accordance with a not-shown clock signal. A pair of control signal lines 231A and 231B transmit the same control signal output from a shift register unit 312. In FIG. 5, two control signal lines from one shift register unit 312 are provided with reference signs 231A and 231B by way of example.

The second shift register 320 drives control signal lines 232A and 232B extending along the X-axis in accordance with a not-shown clock signal. A pair of control signal lines 232A and 232B transmit the same control signal output from a shift register unit 322. In FIG. 5, two control signal lines from one shift register unit 322 are provided with reference signs 232A and 232B by way of example.

A control signal line 231A transmits a selection signal S_K (K is an integer) output from the K-th shift register unit 312 to the K-th pixel circuit row. A control signal line 231B transmits the selection signal S_K output from the K-th shift register unit 312 to the (K−1)th pixel circuit row.

A control signal line 232A transmits an emission control signal Em_K output from the K-th shift register unit 322 to the K-th pixel circuit row. A control signal line 232B transmits the emission control signal Em_K output from the K-th shift register unit 322 to the (K+1)th pixel circuit row.

The pixel circuits 200 constituting a pixel circuit row are connected with the same control signal lines 231A, 231B, 232A, and 232B and controlled by the same control signals transmitted by these control signal lines. The method of controlling the pixel circuits 200 has been described with reference to FIG. 3 or 4.

The first shift register 310 serially outputs signal pulses in accordance with a start pulse signal and a clock signal not shown in FIG. 5. The start pulse signal is a signal having a cycle of one frame and its pulse width is the same as the pulse width of the pulses output from the control signal lines in FIG. 3 or 4. In the case of the timing chart of FIG. 3, the first shift register 310 shifts signal pulses having a width of 3H at every 1H from a stage to the next stage in the shift register units 312 connected in series. The reference output level of the shift register units 312 is High and the potential level of the signal pulses is Low.

In the case of the timing chart of FIG. 4, the first shift register 310 shifts signal pulses having a width of 2H at every 1H from a stage to the next stage in the shift register units 312 connected in series.

The second shift register 320 serially outputs signal pulses in accordance with a start pulse signal and a clock signal not shown in FIG. 5. The start pulse signal is a signal having a cycle of one frame and its pulse width is the same as the pulse width of the pulses output from the control signal lines in FIG. 3 or 4. In the case of the timing chart of FIG. 3, the second shift register 320 shifts signal pulses having a width of 3H at every 1H from a stage to the next stage in the shift register units 322 connected in series.

As understood from the above, the second shift register 320 shifts signal pulses having a width of 3H at every 1H from a pixel circuit row to the next pixel circuit row. The reference output level of the shift register units 322 is Low and the potential level of the signal pulses is High. That is to say, the polarity of the signal pulses output from the second shift register 320 is opposite to the polarity of the signal pulses output from the first shift register 310.

As illustrated in FIG. 3, the phases of the signal pulses output from the same stage of shift register units of the first shift register 310 and the second shift register 320 are shifted by 1H. The pulses from the second shift register 320 are delayed from the pulses from the first shift register 310 by 1H. That is to say, the (K−1)th, the K-th, and the (K+1)th shift register units 312 and the (K−2)th, the (K−1)th, and the K-th shift register units 322 output a pulse in the same period.

In the case of the timing chart of FIG. 4, the second shift register 320 shifts signal pulses having a width of 2H at every 1H from a stage to the next stage in the shift register units 322 connected in series. The remaining is the same as the case of FIG. 3.

In summary, the first shift register 310 shifts control signal pulses having a first polarity (Low) from a pixel circuit row to the next pixel circuit row at every predetermined period. The second shift register 320 shifts control signal pulses having a second polarity (High) from a pixel circuit row to the next pixel circuit row at every predetermined period. The control signal pulses from the first shift register 310 are synchronized with the control signal pulses from the second shift register 320.

A pixel circuit is controlled by two control signals S_N and S_N+1 from the first shift register 310 and two control signals Em_N−1 and Em_N from the second shift register 320. Controlling a pixel circuit with two control signals from each shift register enables laying out the control lines to be easier. The circuit for generating the above-described control signals can include a circuit other than the shift register. The data write period can be different in length from the clock cycle for the control signal pulses; for example, it can be shorter than the clock cycle. These points are applicable to the configuration examples to be described in the following.

Figure 6:
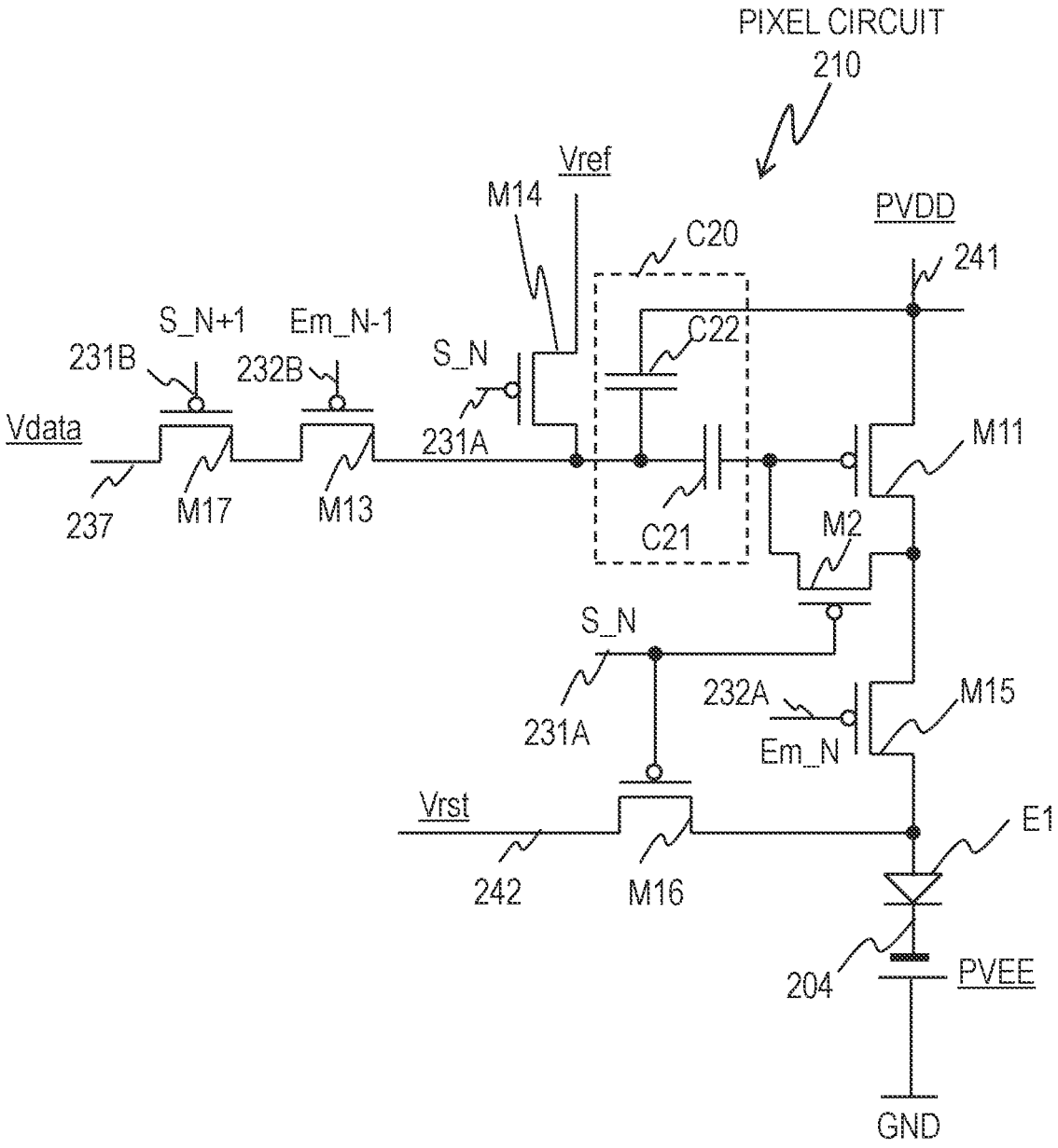
FIG. 6 illustrates another example of a pixel circuit and control signals therefor.

FIG. 6 illustrates another example of a pixel circuit and control signals therefor. Differences from the pixel circuit 200 illustrated in FIG. 2 are mainly described. The pixel circuit 210 in FIG. 6 includes a storage capacitor C20 in place of the storage capacitor C10 of the pixel circuit 200 in FIG. 2. The storage capacitor C20 consists of capacitors C21 and C22 connected in series between the power line 241 for transmitting the anode power supply potential PVDD and the gate of the driving transistor M11.

One end of the capacitor C22 is connected with the power line 241. The other end of the capacitor C22 is connected with an end of the capacitor C21. The other end of the capacitor C21 is connected with the gate of the driving transistor M11. An intermediate node between the capacitors C21 and C22 is connected with the source/drain of the transistor M14 and the source/drain of the transistor M13. The timing chart of the control signals for controlling the pixel circuit 210 is the same as the timing chart of FIG. 3 or 4 and the transistors operate in the same manner as described with reference to FIG. 3 or 4.

Figure 7:
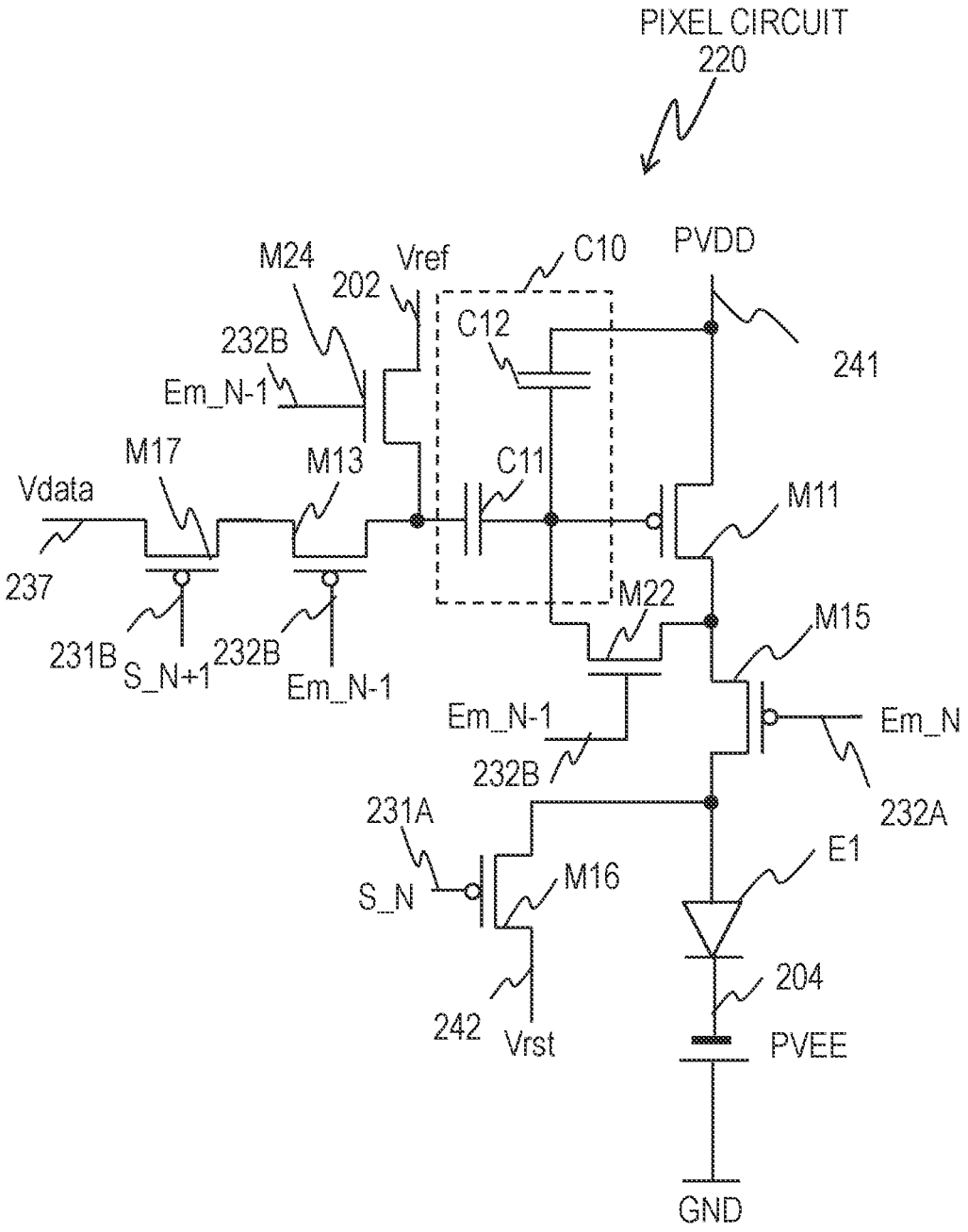
FIG. 7 illustrates still another example of a pixel circuit and control signals therefor.

FIG. 7 illustrates still another example of a pixel circuit and control signals therefor. Differences from the pixel circuit 200 illustrated in FIG. 2 are mainly described. The pixel circuit 220 in FIG. 7 includes transistors M22 and M24 in place of the transistors M12 and M14 of the pixel circuit 200 in FIG. 2. The transistors M22 and M24 are a first threshold compensation transistor and a second threshold compensation transistor.

The transistors M22 and M24 are n-type transistors (the polarity of the transistors is of n-type). An example of a p-type transistor is a low-temperature polysilicon TFT and an example of an n-type transistor is an oxide semiconductor TFT. The oxide semiconductor TFT generates less leakage current than the low-temperature polysilicon TFT and therefore, the charges in the storage capacitor can be maintained more appropriately.

Whether to turn ON/OFF the transistor M22 is controlled by the emission control signal Em_N−1 input to its gate. Whether to turn ON/OFF the transistor M24 is controlled by the emission control signal Em_N−1 input to its gate. The timing chart of the control signals for controlling the pixel circuit 220 is the same as the timing chart of FIG. 3 or 4.

The operation of the pixel circuit 220 in accordance with the timing chart of FIG. 3 is described by way of example. At a time T1, the selection signal S_N+1 is High and the transistor M17 is OFF. The emission control signal Em_N is Low and the transistor M15 is ON.

The selection signal S_N changes from High to Low and the emission control signal Em_N−1 changes from Low to High at the time T1. The transistor M16 turns from OFF to ON in response to the change of the selection signal S_N. The transistors M22 and M24 turn from OFF to ON and the transistor M13 turns from ON to OFF in response to the change of the emission control signal Em_N−1.

In response to the transistor M16 turning ON, supply of the reset potential Vrst to the anode of the OLED element E1 starts. Since the transistors M22, M15, and M16 are ON, supply of the reset potential Vrst to the gate of the driving transistor M11 starts. This state is maintained from the time T1 to a time T2.

At the time T2, the selection signal S_N+1 changes from High to Low and further, the emission control signal Em_N changes from Low to High. The transistor M17 turns from OFF to ON in response to the change of the selection signal S_N+1. The transistor M15 turns from ON to OFF in response to the change of the emission control signal Em_N. The supply of the reset potential Vrst to the gate of the driving transistor M11 is stopped by the transistor M15 turning OFF.

At the time T2, the transistors M22, M24, M16, and M17 are ON. The transistors M13 and M15 are OFF. Since the transistors M13 and M15 are OFF and the transistors M22 and M24 are ON, a threshold compensation voltage is written to the storage capacitor C10. Write of the threshold compensation voltage to the storage capacitor C10 starts at the time T2.

At a time T3, the selection signal S_N changes from Low to High and further, the emission control signal Em_N−1 changes from High to Low. The transistor M16 turns from ON to OFF in response to the change of the selection signal S_N. The transistors M22 and M24 turn from ON to OFF in response to the change of the emission control signal Em_N−1. Accordingly, the write of the threshold compensation voltage to the storage capacitor C10 ends at the time T3.

The transistor M13 turns from OFF to ON in response to the change of the emission control signal Em_N−1 at the time T3. Since the transistors M13 and M17 are ON, the data signal Vdata is written to the storage capacitor C10 via the transistors M13 and M17. Write of the data signal Vdata to the storage capacitor C10 starts at the time T3.

At a time T4, the selection signal S_N+1 changes from Low to High. In response, the transistor M17 turns from ON to OFF and as a result, the data write to the N-th pixel circuit row ends. The emission control signal Em_N changes from High to Low at the time T4. In response, the transistor M15 turns from OFF to ON. As a result, the driving current is supplied to the OLED element E1 and the OLED element E1 starts emitting light.

Figure 8:
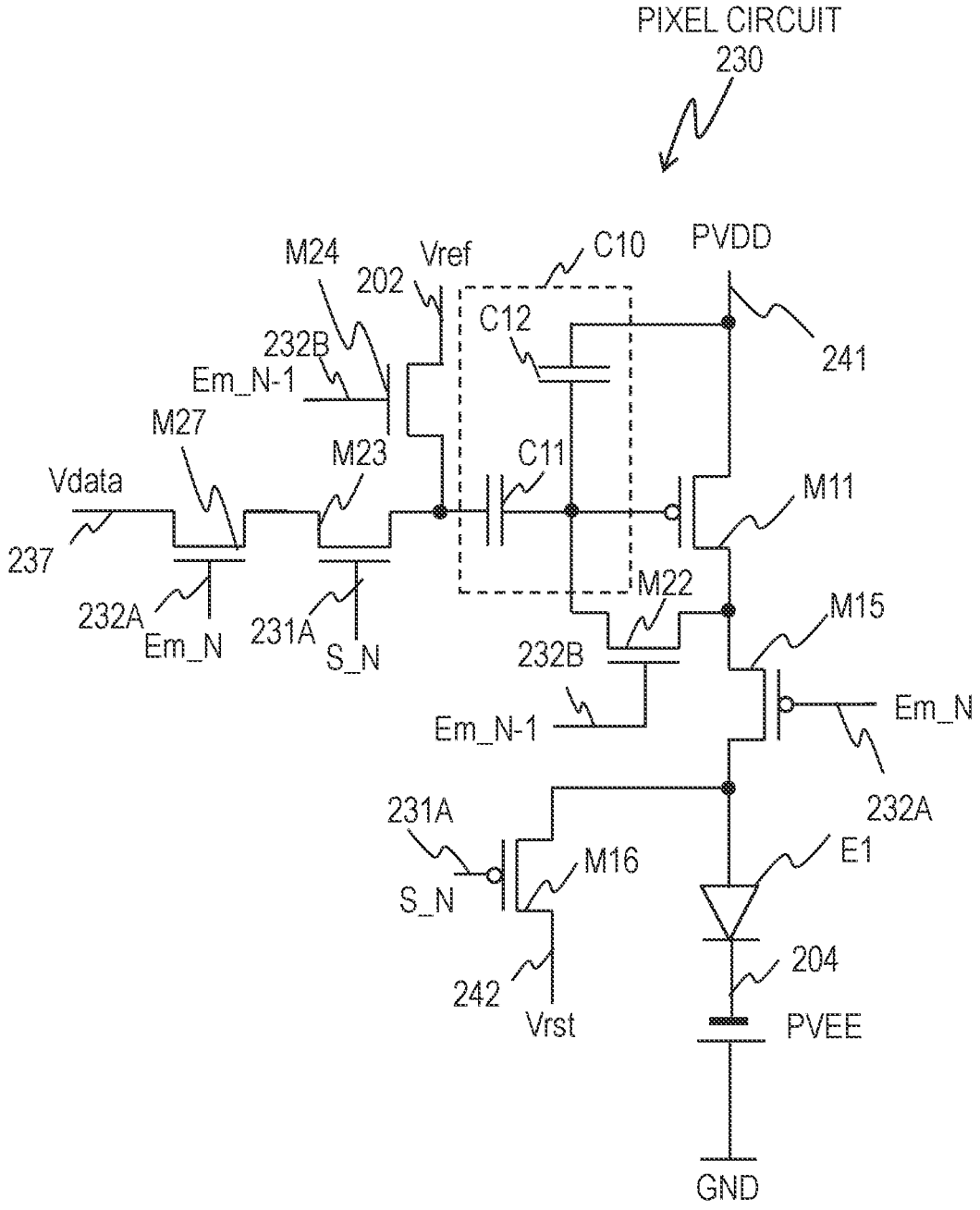
FIG. 8 illustrates still another example of a pixel circuit and control signals therefor.

FIG. 8 illustrates still another example of a pixel circuit and control signals therefor. Differences from the pixel circuit 200 illustrated in FIG. 2 are mainly described. The pixel circuit 230 in FIG. 8 includes transistors M22, M23, M24, and M27 in place of the transistors M12, M13, M14, and M17 of the pixel circuit 200 in FIG. 2. The transistors M22, M23, M24, and M27 are n-type transistors.

If the leakage current from the threshold compensation transistors M22 and M24 is large, their gate potentials vary during a data holding period to cause a flicker. If the leakage current from the data write transistors M23 and M27 is large, the data signal leaks to the potential of the storage capacitor to cause a crosstalk. Meanwhile, the driving transistor M11 is desired to have high mobility to achieve high resolution and high-frequency driving.

For these reasons, it is desirable that the driving transistor M11 be a p-type transistor and the threshold compensation transistors M22 and M24 and the data write transistors M23 and M27 be n-type transistors. A low-temperature polysilicon TFT having a high capability of writing can be employed for the driving transistor and oxide semiconductor TFTs that generate small leakage current can be employed for the threshold compensation transistors and the data write transistors. Combining transistors having different characteristics advantageously achieves not only high-resolution display and high-frequency driving but also low-frequency driving for saving the power consumption together.

Whether to turn ON/OFF the transistor M22 is controlled by the emission control signal Em_N−1 input to its gate. Whether to turn ON/OFF the transistor M23 is controlled by the selection signal S_N input to its gate. Whether to turn ON/OFF the transistor M24 is controlled by the emission control signal Em_N−1 input to its gate. Whether to turn ON/OFF the transistor M27 is controlled by the emission control signal Em_N input to its gate.

Compared to the control signals for the pixel circuit 200 in FIG. 2, the control signals in FIG. 8 do not include the selection signal S_N+1. The timing chart of the control signals for controlling the pixel circuit 230 is obtained by excluding the selection signal S_N+1 from the timing chart of FIG. 3 or 4. The layout of the control signal lines is obtained by removing the control signal lines 231B from the layout in FIG. 5.

The operation of the pixel circuit 230 in accordance with the timing chart of FIG. 3 is described by way of example. At a time T1, the emission control signal Em_N is Low; the transistor M27 is OFF and the transistor M15 is ON.

The selection signal S_N changes from High to Low and the emission control signal Em_N−1 changes from Low to High at the time T1. The transistor M23 turns from ON to OFF and the transistor M16 turns from OFF to ON in response to the change of the selection signal S_N. The transistors M22 and M24 turn from OFF to ON in response to the change of the emission control signal Em_N−1.

In response to the transistor M16 turning ON, supply of the reset potential Vrst to the anode of the OLED element E1 starts. Since the transistors M22, M15, and M16 are ON, supply of the reset potential Vrst to the gate of the driving transistor M11 starts. This state is maintained from the time T1 to a time T2.

At the time T2, the emission control signal Em_N changes from Low to High. The transistor M27 (an example of the first transistor) turns from OFF to ON and the transistor M15 turns from ON to OFF in response to the change of the emission control signal Em_N. The supply of the reset potential Vrst to the gate of the driving transistor M11 is stopped by the transistor M15 turning OFF.

At the time T2, the transistors M22, M24, M16, and M27 are ON. The transistors M23 and M15 are OFF. Since the transistors M23 and M15 are OFF and the transistors M22 and M24 are ON, a threshold compensation voltage is written to the storage capacitor C10. Write of the threshold compensation voltage to the storage capacitor C10 starts at the time T2.

At a time T3, the selection signal S_N changes from Low to High. Further, the emission control signal Em_N−1 changes from High to Low. The transistor M16 turns from ON to OFF in response to the change of the selection signal S_N. The transistors M22 and M24 turn from ON to OFF in response to the change of the emission control signal Em_N−1. Accordingly, the write of the threshold compensation voltage to the storage capacitor C10 ends at the time T3.

The transistor M23 (an example of the second transistor) turns from OFF to ON in response to the change of the selection signal S_N at the time T3. Since the transistors M23 and M27 are ON, the data signal Vdata is written to the storage capacitor C10 via the transistors M23 and M27. Write of the data signal Vdata to the storage capacitor C10 starts at the time T3.

At a time T4, the emission control signal Em_N changes from High to Low. In response, the transistor M27 turns from ON to OFF and as a result, the data write to the N-th pixel circuit row ends. Further, the transistor M15 turns from OFF to ON. As a result, the driving current is supplied to the OLED element E1 and the OLED element E1 starts emitting light.

Figure 9:
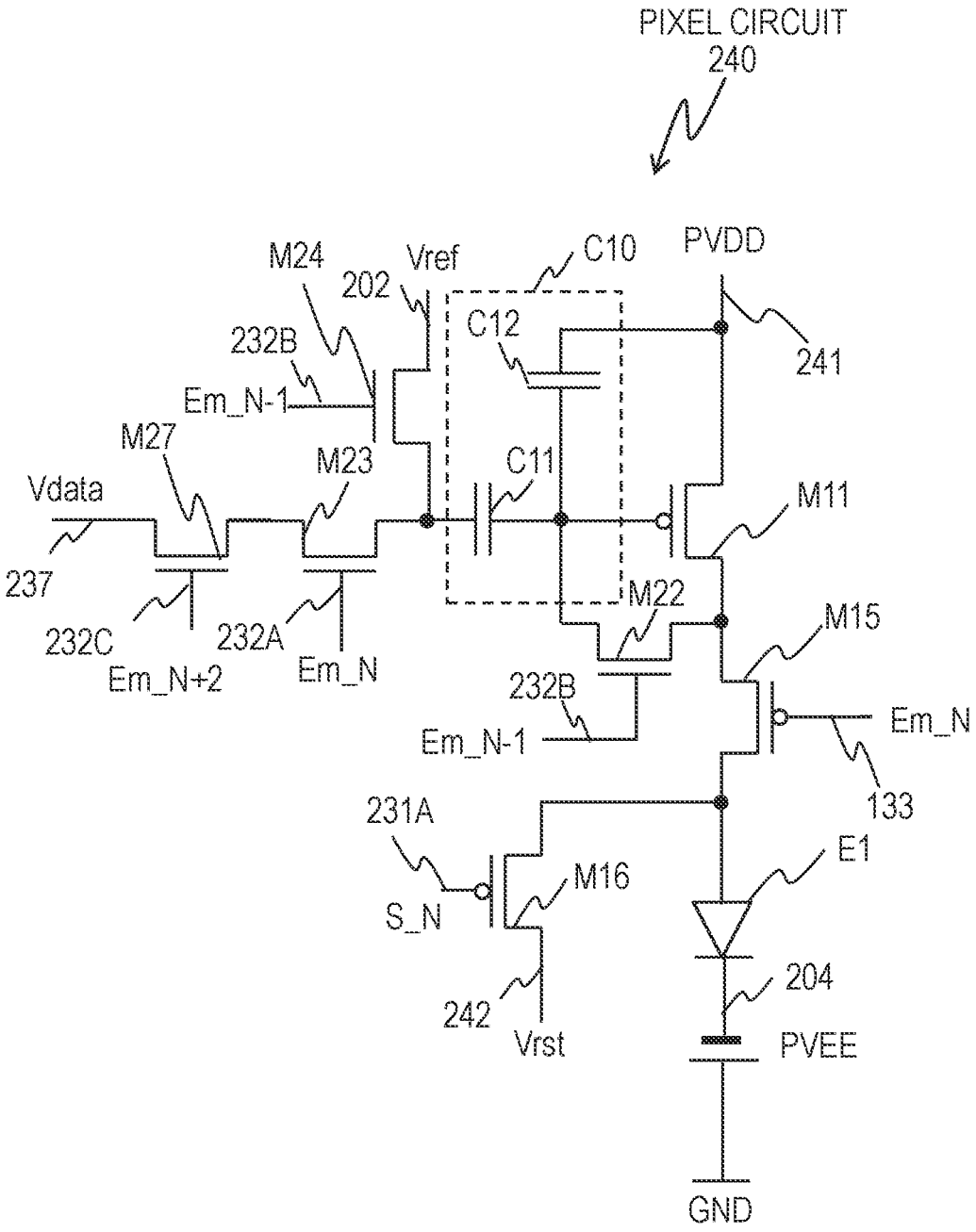
FIG. 9 illustrates still another example of a pixel circuit and control signals therefor.

FIG. 9 illustrates still another example of a pixel circuit and control signals therefor. Differences from the pixel circuit 200 illustrated in FIG. 2 are mainly described. The pixel circuit 240 in FIG. 9 includes transistors M22, M23, M24, and M27 in place of the transistors M12, M13, M14, and M17 of the pixel circuit 200 in FIG. 2. The transistors M22, M23, M24, and M27 are n-type transistors.

This example also employs a p-type transistor for the driving transistor M11 and n-type transistors for the threshold compensation transistors M22 and M24 and the data write transistors M23 and M27, allowing to apply a low-temperature polysilicon TFT having a high capability of writing for the driving transistor and oxide semiconductor TFTs that generate small leakage current for the threshold compensation transistors and the data write transistors. Combining transistors having different characteristics advantageously achieves not only high-resolution display and high-frequency driving but also low-frequency driving for saving the power consumption together.

Whether to turn ON/OFF the transistor M22 is controlled by the emission control signal Em_N−1 input to its gate. Whether to turn ON/OFF the transistor M23 is controlled by the emission control signal Em_N input to its gate. Whether to turn ON/OFF the transistor M24 is controlled by the emission control signal Em_N−1 input to its gate. Whether to turn ON/OFF the transistor M27 is controlled by the emission control signal Em_N+2 input to its gate.

Figure 10:
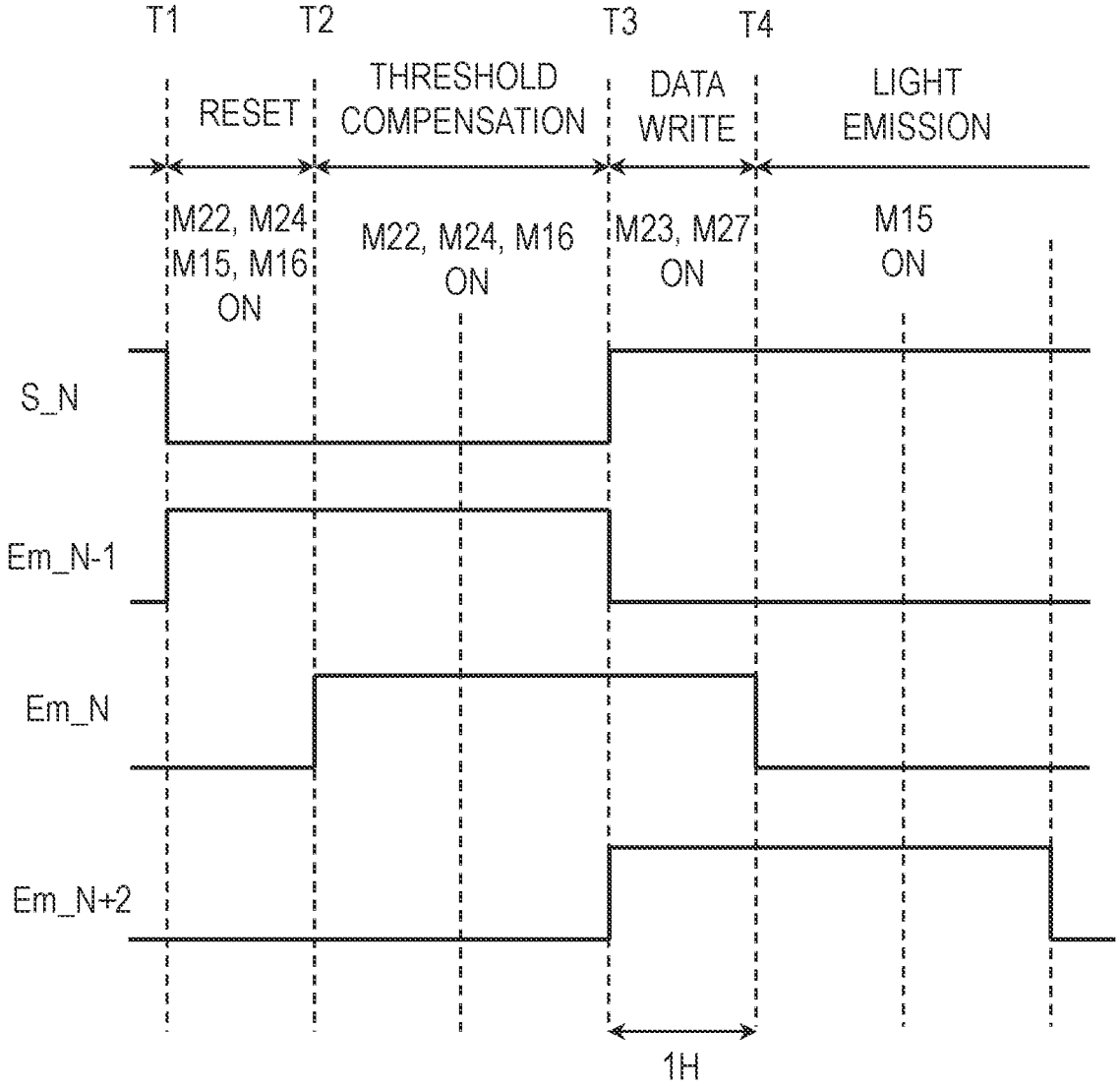
FIG. 10 is an example of the timing chart of the signals for controlling the pixel circuit illustrated in FIG. 9.

FIG. 10 is an example of the timing chart of the signals for controlling the pixel circuit 240 illustrated in FIG. 9. FIG. 10 illustrates temporal variation in signal potential level in one frame of the selection signal S_N and the emission control signals Em_N−1, Em_N, and Em_N+2.

The period of 1H in the timing chart of FIG. 10 is a period to write a data signal Vdata to the pixel circuit and a period in which the transistors M23 and M27 are ON. A threshold compensation period is not shorter than 1H and in the example of FIG. 10, 2H.

At a time T1, the emission control signal Em_N+2 is Low and the transistor M27 is OFF. The emission control signal Em_N is also Low and the transistor M15 is ON and the transistor M23 is OFF.

The selection signal S_N changes from High to Low and the emission control signal Em_N−1 changes from Low to High at the time T1. The transistor M16 turns from OFF to ON in response to the change of the selection signal S_N. The transistors M22 and M24 turn from OFF to ON in response to the change of the emission control signal Em_N−1.

In response to the transistor M16 turning ON, supply of the reset potential Vrst to the anode of the OLED element E1 starts. Since the transistors M22, M15, and M16 are ON, supply of the reset potential Vrst to the gate of the driving transistor M11 starts. This state is maintained from the time T1 to a time T2. The period from the time T1 to the time T2 is a period to reset the anode potential of the OLED element E1 and the gate potential of the driving transistor M11. The period from the time T1 to the time T2 has a length of 1H.

At the time T2, the emission control signal Em_N changes from Low to High. In response to the change of the emission control signal Em_N, the transistor M15 turns from ON to OFF and the transistor M23 (an example of the first transistor) turns from OFF to ON. The supply of the reset potential Vrst to the gate of the driving transistor M11 is stopped by the transistor M15 turning OFF.

At the time T2, the transistors M22, M24, M16, and M23 are ON. The transistors M27 and M15 are OFF. Since the transistors M27 and M15 are OFF and the transistors M22 and M24 are ON, a threshold compensation voltage is written to the storage capacitor C10. Write of the threshold compensation voltage to the storage capacitor C10 starts at the time T2.

The potential levels of the signals S_N, Em_N−1, Em_N, and Em_N+2 are maintained from the time T2 to a time T3. At the time T3, the selection signal S_N changes from Low to High. Further, the emission control signal Em_N−1 changes from High to Low and the emission control signal Em_N+2 changes from Low to High.

The transistor M16 turns from ON to OFF in response to the change of the selection signal S_N. The transistors M22 and M24 turn from ON to OFF in response to the change of the emission control signal Em_N−1. Accordingly, the write of the threshold compensation voltage to the storage capacitor C10 ends at the time T3. The period from the time T2 to the time T3 is a period to write a threshold compensation voltage to the storage capacitor C10 and has a length of 2H in the example of FIG. 10.

In response to the change of the emission control signal Em_N+2 at the time T3, the transistor M27 (an example of the second transistor) turns from OFF to ON. Since the transistors M23 and M27 are ON, the data signal Vdata is written to the storage capacitor C10 via the transistors M23 and M27. Write of the data signal Vdata to the storage capacitor C10 starts at the time T3. The potential levels of the signals S_N, Em_N−1, Em_N, and Em_N+2 are maintained from the time T3 to a time T4.

At the time T4, the emission control signal Em_N changes from High to Low. In response, the transistor M23 turns from ON to OFF and as a result, the data write to the N-th pixel circuit row ends. The period from the time T3 to the time T4 is a data write period for the N-th pixel circuit row and has a length of 1H. After the time T4, the emission control signal Em_N is maintained to be Low.

In response to the change of the emission control signal Em_N at the time T4, the transistor M15 turns from OFF to ON. As a result, the driving current is supplied to the OLED element E1 and the OLED element E1 starts emitting light. At a time later than the time T4 by 2H, the emission control signal Em_N+2 changes from High to Low.

In response, the transistor M27 turns from ON to OFF. The light emission of the OLED element E1 is maintained regardless of the change of the state of the transistor M27. Compared to the configuration in FIG. 8, two transistors M23 and M27 turn OFF. This configuration effectively reduces the leakage from the storage capacitor to the data line during the light emission period.

Figure 11:
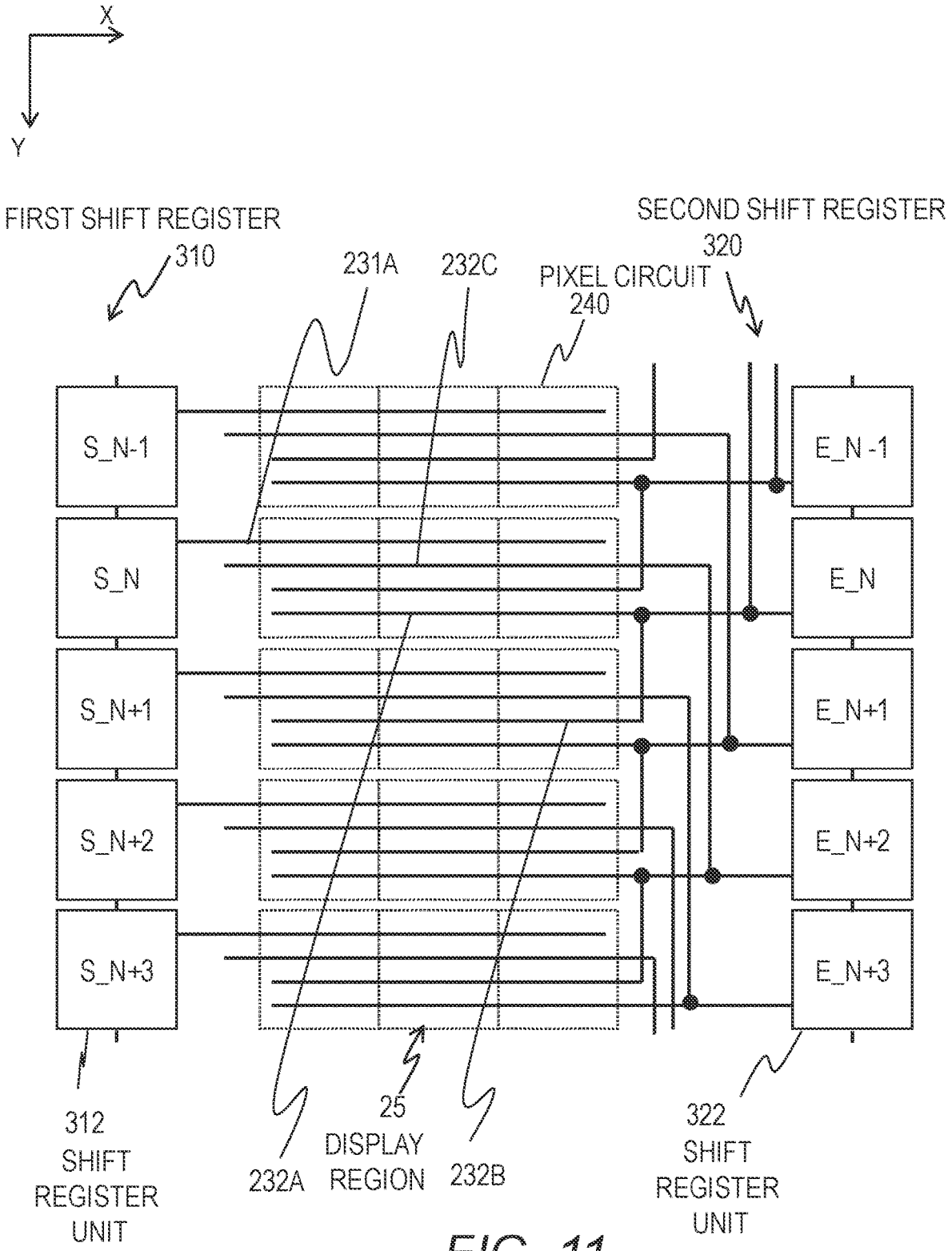
FIG. 11 schematically illustrates a layout of the control signal lines for transmitting control signals to pixel circuits illustrated in FIG. 9.

FIG. 11 schematically illustrates a layout of the control signal lines for transmitting control signals to pixel circuits 240. Differences from the configuration example in FIG. 5 are mainly described. The configuration example in FIG. 11 does not include the control signal lines 231B in FIG. 5 and includes control signal lines 232C. A control signal line 232C transmits the emission control signal Em_K output from the K-th shift register unit 322 to the (K−2)th pixel circuit row.

Figure 12:
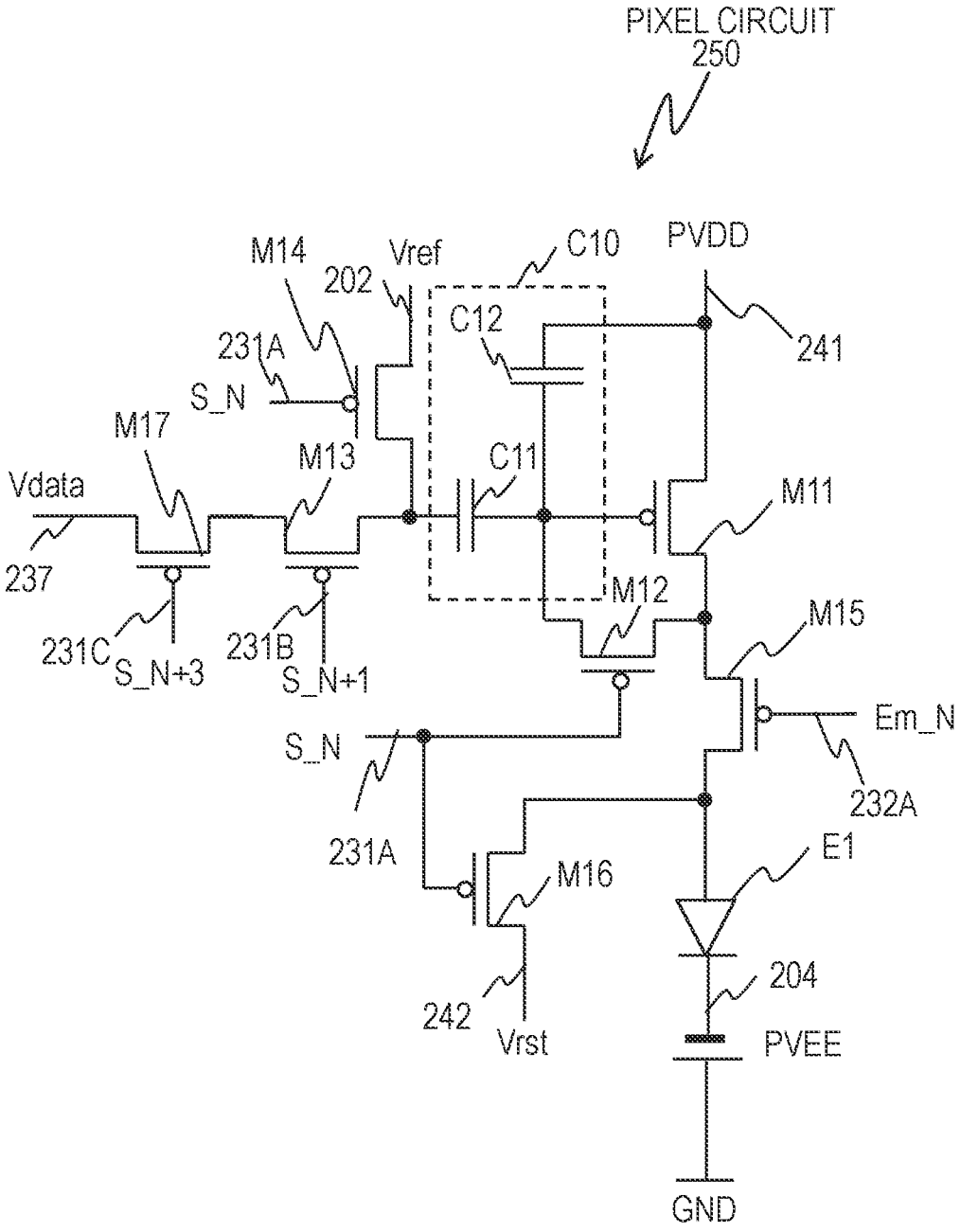
FIG. 12 illustrates still another configuration example of a pixel circuit and control signals therefor.

FIG. 12 illustrates still another configuration example of a pixel circuit and control signals therefor. The element configuration of the pixel circuit 250 in FIG. 12 is the same as the one of the pixel circuit 200 in FIG. 2. The control signals for some of the transistors in the pixel circuit 250 are different from the control signals for the corresponding transistors in the pixel circuit 200. Specifically, the selection signal S_N+1 is input to the gate of the transistor M13 and the selection signal S_N+3 is input to the gate of the transistor M17. The remaining of the pixel circuit 250 is the same as that of the pixel circuit 200.

Figure 13:
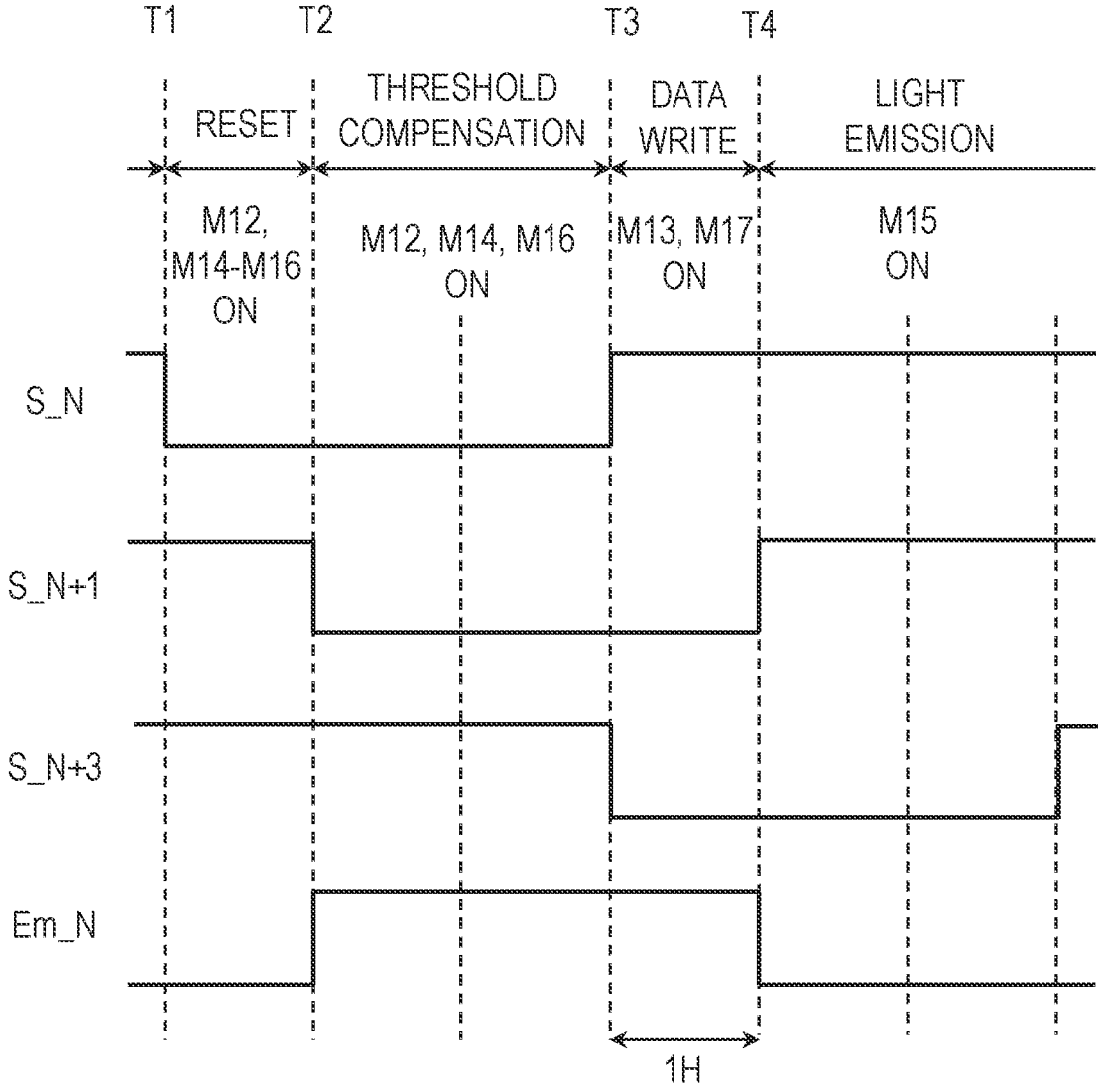
FIG. 13 is an example of the timing chart of the signals for controlling the pixel circuit illustrated in FIG. 12.

FIG. 13 is an example of the timing chart of the signals for controlling the pixel circuit 250 illustrated in FIG. 12. FIG. 13 illustrates temporal variation in signal potential level in one frame of the selection signals S_N, S_N+1, and S_N+3, and the emission control signal Em_N.

The period of 1H in the timing chart of FIG. 13 is a period to write a data signal Vdata to the pixel circuit and a period in which the transistors M13 and M17 are ON. A threshold compensation period is not shorter than 1H and in the example of FIG. 13, 2H.

At a time T1, the selection signal S_N+1 is High and the transistor M13 is OFF. The selection signal S_N+3 is also High and the transistor M17 is OFF. The emission control signal Em_N is Low and the transistor M15 is ON.

The selection signal S_N changes from High to Low at the time T1. The transistors M12, M14, and M16 turn from OFF to ON in response to the change of the selection signal S_N.

In response to the transistor M16 turning ON, supply of the reset potential Vrst to the anode of the OLED element E1 starts. Since the transistors M12, M15, and M16 are ON, supply of the reset potential Vrst to the gate of the driving transistor M11 starts. This state is maintained from the time T1 to a time T2. The period from the time T1 to the time T2 is a period to reset the anode potential of the OLED element E1 and the gate potential of the driving transistor M11. The period from the time T1 to the time T2 has a length of 1H.

At the time T2, the selection signal S_N+1 changes from High to Low and further, the emission control signal Em_N changes from Low to High. The transistor M13 (an example of the first transistor) turns from OFF to ON in response to the change of the selection signal S_N+1 and the transistor M15 turns from ON to OFF in response to the change of the emission control signal Em_N. The supply of the reset potential Vrst to the gate of the driving transistor M11 is stopped by the transistor M15 turning OFF.

At the time T2, the transistors M12, M13, M14, and M16 are ON. The transistors M15 and M17 are OFF. Since the transistors M15 and M17 are OFF and the transistors M12 and M14 are ON, a threshold compensation voltage is written to the storage capacitor C10. Write of the threshold compensation voltage to the storage capacitor C10 starts at the time T2.

The potential levels of the signals S_N, S_N+1, S_N+3, and Em_N are maintained from the time T2 to a time T3. At the time T3, the selection signal S_N changes from Low to High. Further, the selection signal S_N+3 changes from High to Low.

The transistors M12, M14, and M16 turn from ON to OFF in response to the change of the selection signal S_N. Accordingly, the write of the threshold compensation voltage to the storage capacitor C10 ends at the time T3. The period from the time T2 to the time T3 is a period to write a threshold compensation voltage to the storage capacitor C10 and has a length of 2H in the example of FIG. 13.

In response to the change of the selection signal S_N+3 at the time T3, the transistor M17 (an example of the second transistor) turns from OFF to ON. Since the transistors M13 and M17 are ON, the data signal Vdata is written to the storage capacitor C10 via the transistors M13 and M17. Write of the data signal Vdata to the storage capacitor C10 starts at the time T3. The potential levels of the signals S_N, S_N+1, S_N+3, and Em_N are maintained from the time T3 to a time T4.

At the time T4, the selection signal S_N+1 changes from Low to High. In response, the transistor M13 turns from ON to OFF and as a result, the data write to the N-th pixel circuit row ends. The period from the time T3 to the time T4 is a data write period for the N-th pixel circuit row and has a length of 1H. After the time T4, the selection signal S_N+1 is maintained to be High.

The emission control signal Em_N changes from High to Low at the time T4. In response, the transistor M15 turns from OFF to ON. As a result, the driving current is supplied to the OLED element E1 and the OLED element E1 starts emitting light. At the time later than the time T4 by 2H, the selection signal S_N+3 changes from Low to High. The transistor M17 turns from ON to OFF in response to the end edge of the pulse of the selection signal S_N+3. Since the two transistors M13 and M17 are OFF, the leakage from the storage capacitor to the data line during the light emission period can be effectively reduced.

Figure 14:
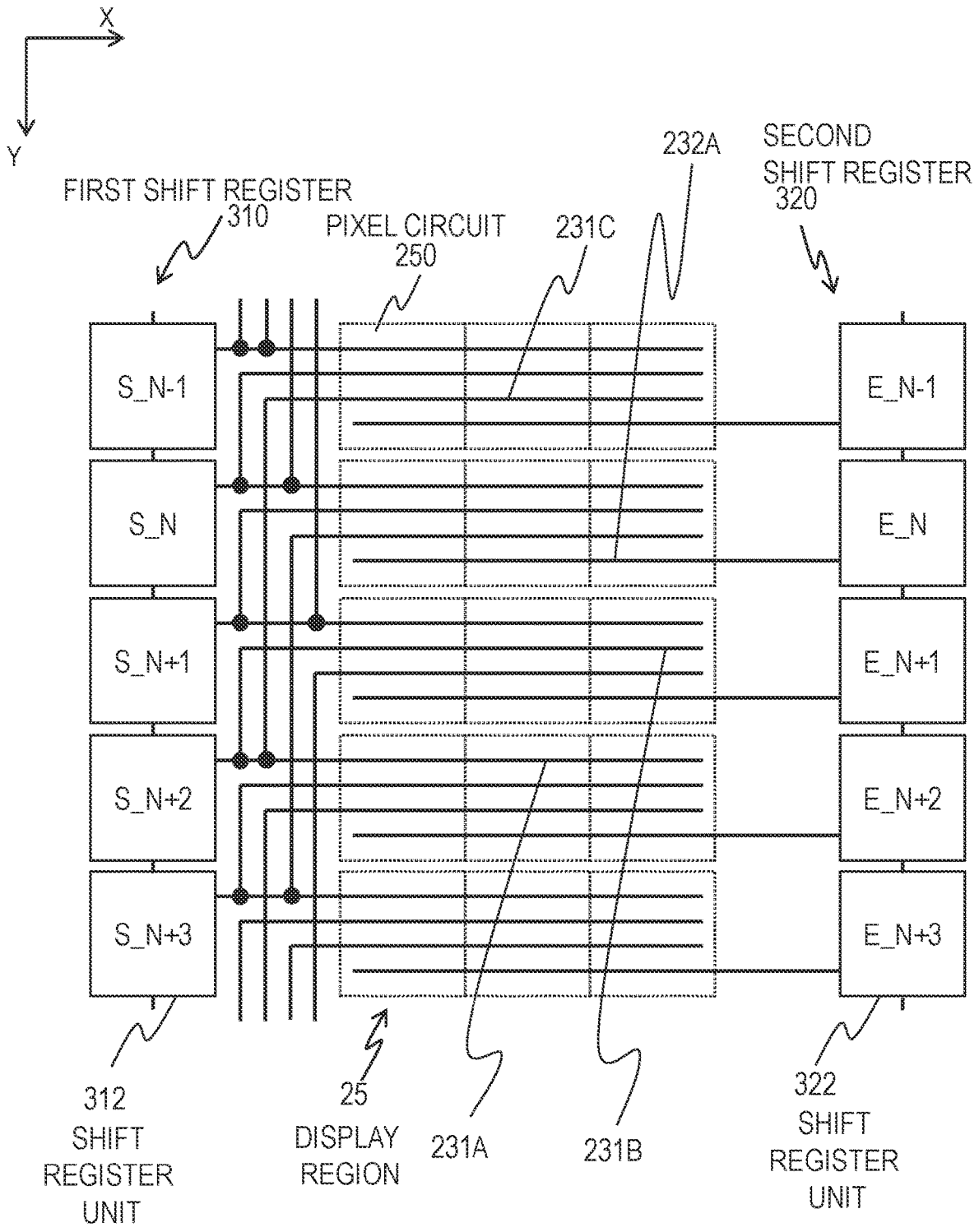
FIG. 14 schematically illustrates a layout of the control signal lines for transmitting control signals to pixel circuits illustrated in FIG. 12.

FIG. 14 schematically illustrates a layout of the control signal lines for transmitting control signals to pixel circuits 250. Differences from the configuration example in FIG. 5 are mainly described. The configuration example in FIG. 14 does not include the control signal lines 232B in FIG. 5 and includes control signal lines 231C. A control signal line 231C transmits the selection signal S_K output from the K-th shift register unit 312 to the (K−3)th pixel circuit row.

Figure 15:
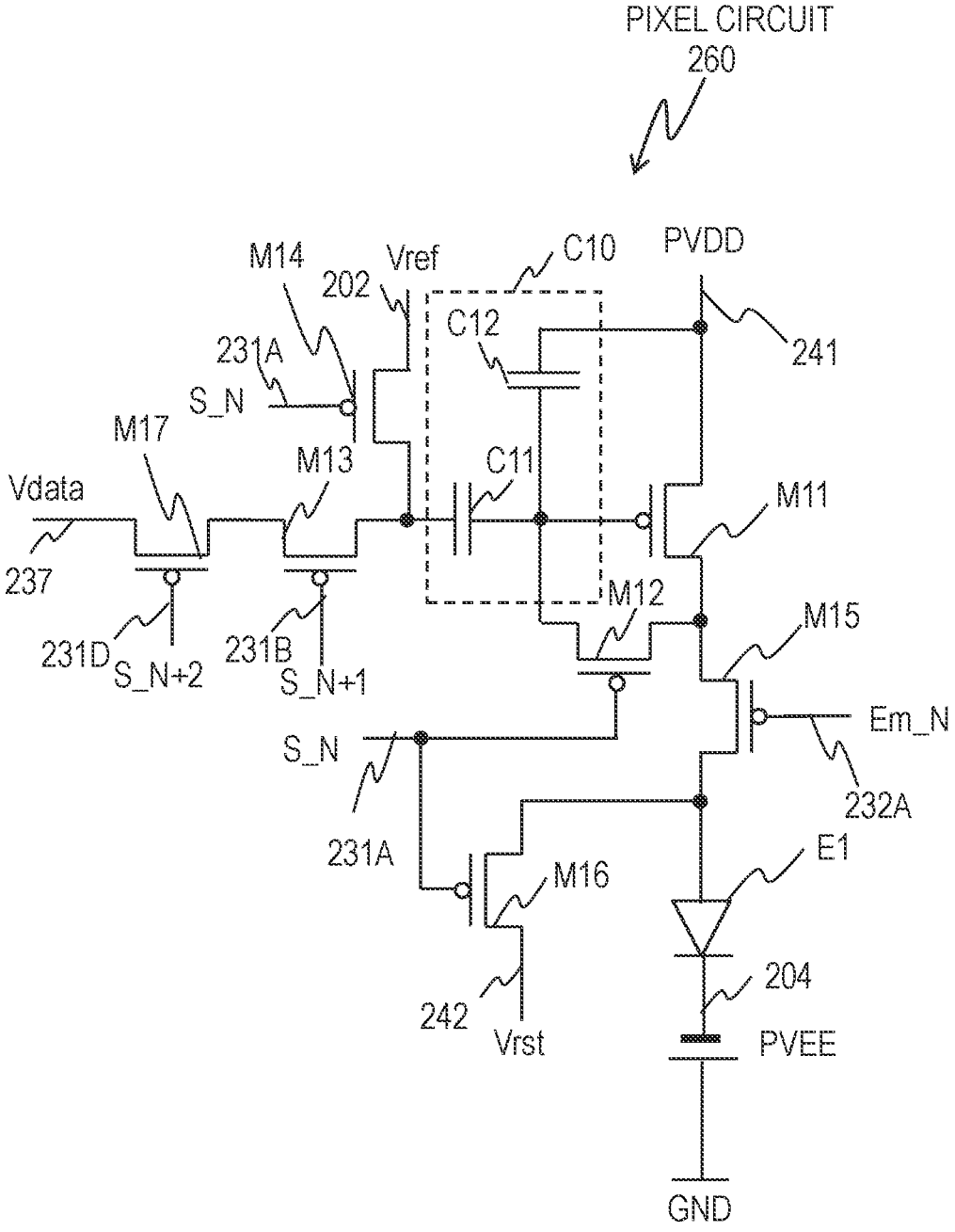
FIG. 15 illustrates still another configuration example of a pixel circuit and control signals therefor.

FIG. 15 illustrates still another configuration example of a pixel circuit and control signals therefor. The element configuration of the pixel circuit 260 in FIG. 15 is the same as the one of the pixel circuit 200 in FIG. 2. The control signals for some of the transistors in the pixel circuit 260 are different from the control signals for the corresponding transistors in the pixel circuit 200. Specifically, the selection signal S_N+1 is input to the gate of the transistor M13 (an example of the first transistor) and the selection signal S_N+2 is input to the gate of the transistor M17. The remaining of the pixel circuit 260 is the same as that of the pixel circuit 200.

Figure 16:
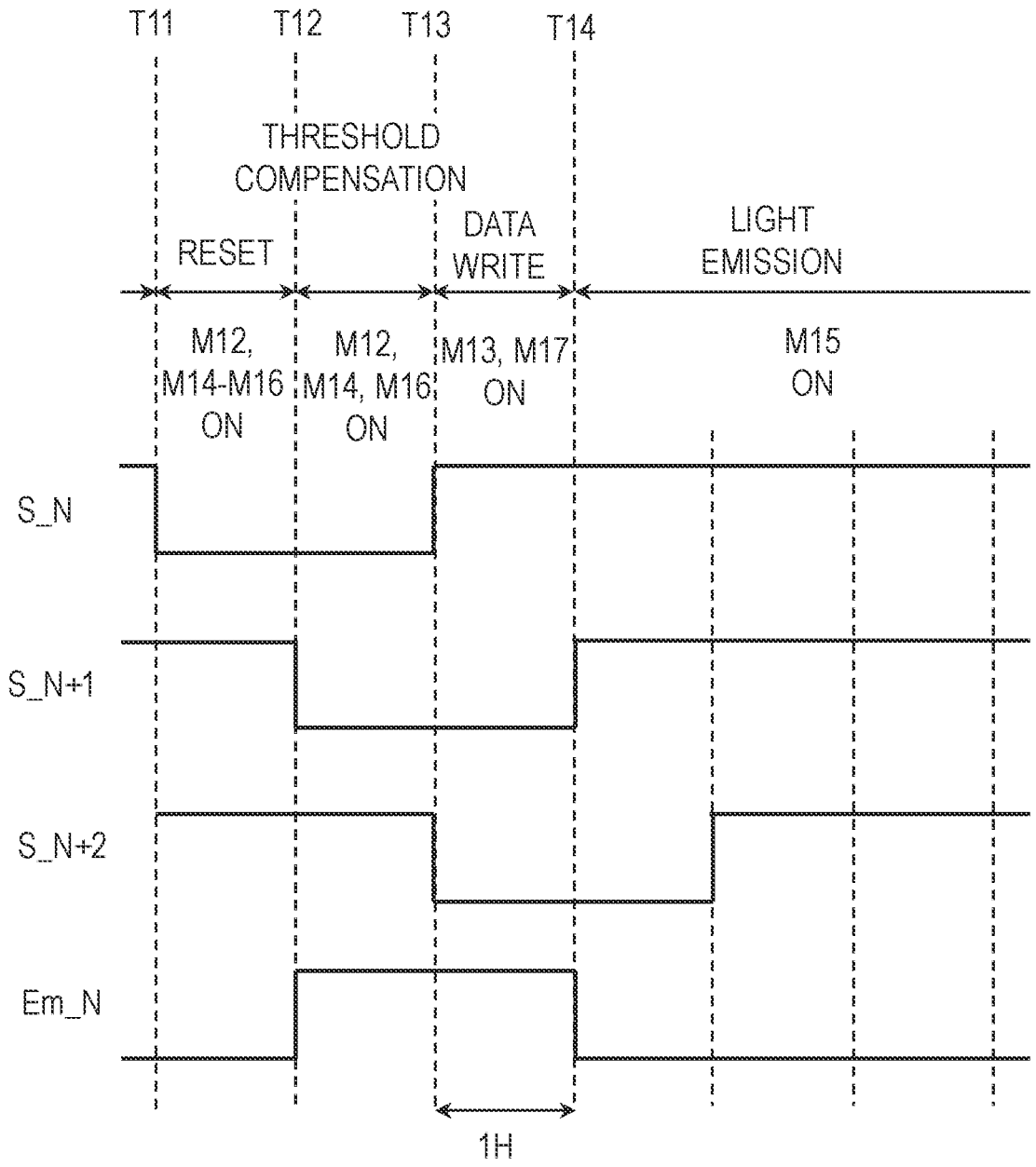
FIG. 16 is an example of the timing chart of the signals for controlling the pixel circuit illustrated in FIG. 15.

FIG. 16 is an example of the timing chart of the signals for controlling the pixel circuit 260 illustrated in FIG. 15. FIG. 16 illustrates temporal variation in signal potential level in one frame of the selection signals S_N, S_N+1, and S_N+2, and the emission control signal Em_N.

The period of 1H in the timing chart of FIG. 16 is a period to write a data signal Vdata to the pixel circuit and a period in which the transistors M13 and M17 are ON. A threshold compensation period is not shorter than 1H and in the example of FIG. 16, 1H.

At a time T11, the selection signal S_N+1 is High and the transistor M13 is OFF. The selection signal S_N+2 is also High and the transistor M17 is OFF. The emission control signal Em_N is Low and the transistor M15 is ON.

The selection signal S_N changes from High to Low at the time T11. The transistors M12, M14, and M16 turn from OFF to ON in response to the change of the selection signal S_N.

In response to the transistor M16 turning ON, supply of the reset potential Vrst to the anode of the OLED element E1 starts. Since the transistors M12, M15, and M16 are ON, supply of the reset potential Vrst to the gate of the driving transistor M11 starts. This state is maintained from the time T11 to a time T12. The period from the time T11 to the time T12 is a period to reset the anode potential of the OLED element E1 and the gate potential of the driving transistor M11. The period from the time T11 to the time T12 has a length of 1H.

At the time T12, the selection signal S_N+1 changes from High to Low and further, the emission control signal Em_N changes from Low to High. The transistor M13 turns from OFF to ON in response to the change of the selection signal S_N+1. The transistor M15 turns from ON to OFF in response to the change of the emission control signal Em_N. The supply of the reset potential Vrst to the gate of the driving transistor M11 is stopped by the transistor M15 turning OFF.

At the time T12, the transistors M12, M13, M14, and M16 are ON. The transistors M15 and M17 are OFF. Since the transistors M15 and M17 are OFF and the transistors M12 and M14 are ON, a threshold compensation voltage is written to the storage capacitor C10. Write of the threshold compensation voltage to the storage capacitor C10 starts at the time T12.

The potential levels of the signals S_N, S_N+1, S_N+2, and Em_N are maintained from the time T12 to a time T13. At the time T13, the selection signal S_N changes from Low to High. Further, the selection signal S_N+2 changes from High to Low.

The transistors M12, M14, and M16 turn from ON to OFF in response to the change of the selection signal S_N. Accordingly, the write of the threshold compensation voltage to the storage capacitor C10 ends at the time T13. The period from the time T12 to the time T13 is a period to write a threshold compensation voltage to the storage capacitor C10 and has a length of 1H in the example of FIG. 16.

In response to the change of the selection signal S_N+2 at the time T13, the transistor M17 turns from OFF to ON. Since the transistors M13 and M17 are ON, the data signal Vdata is written to the storage capacitor C10 via the transistors M13 and M17. Write of the data signal Vdata to the storage capacitor C10 starts at the time T13. The potential levels of the signals S_N, S_N+1, S_N+2, and Em_N are maintained from the time T13 to a time T14.

At the time T14, the selection signal S_N+1 changes from Low to High. In response, the transistor M13 turns from ON to OFF and as a result, the data write to the N-th pixel circuit row ends. The period from the time T13 to the time T14 is a data write period for the N-th pixel circuit row and has a length of 1H. After the time T14, the selection signal S_N+1 is maintained to be High.

The emission control signal Em_N changes from High to Low at the time T14. In response, the transistor M15 turns from OFF to ON. As a result, the driving current is supplied to the OLED element E1 and the OLED element E1 starts emitting light. At the time later than the time T14 by 1H, the selection signal S_N+2 changes from Low to High and the transistor M17 turns from ON to OFF. Since the two transistors M13 and M17 are OFF, the leakage from the storage capacitor to the data line during the light emission period can be effectively reduced.

Figure 17:
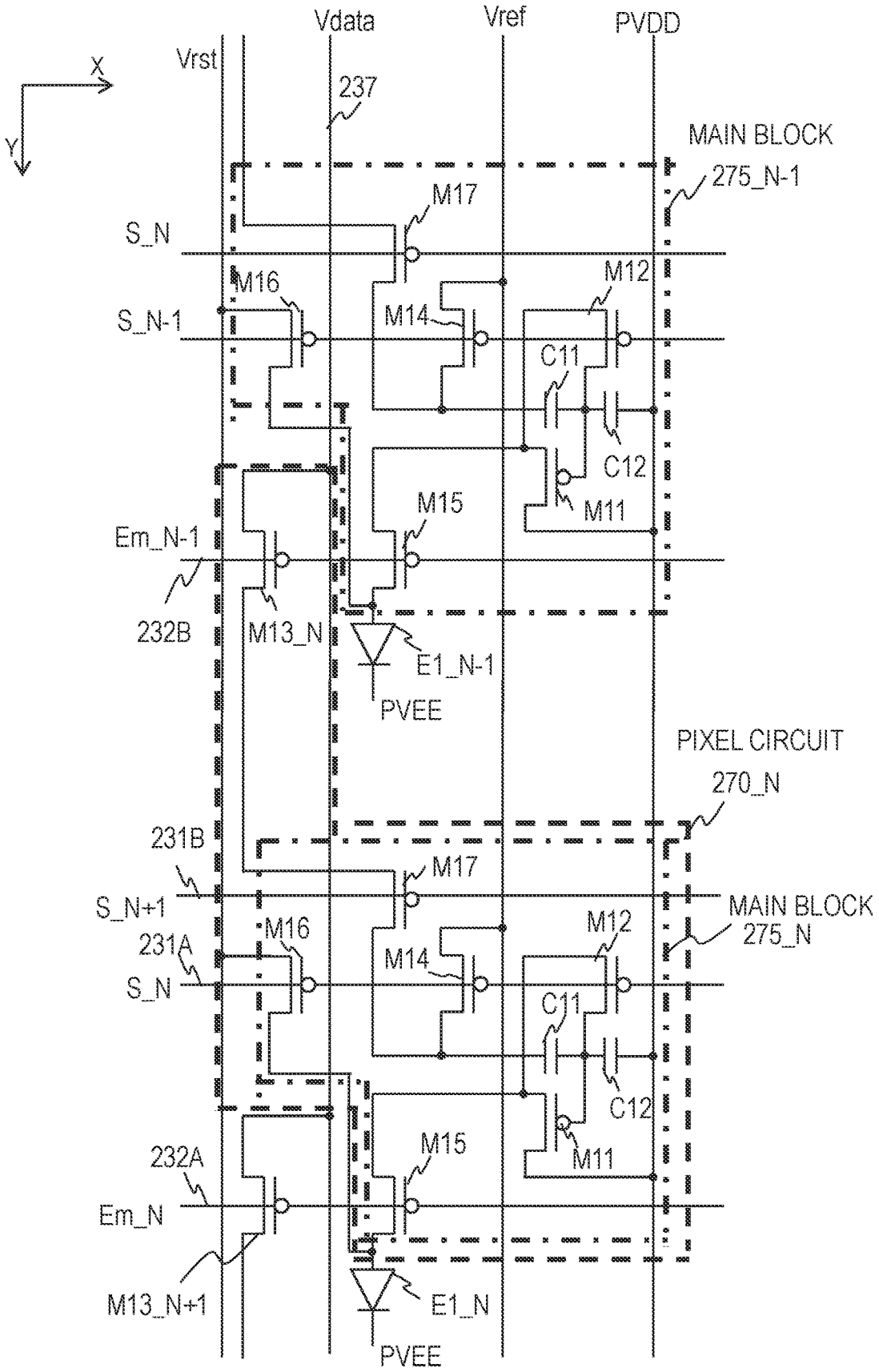
FIG. 17 illustrates still another configuration example of a pixel circuit and control signals therefor.

FIG. 17 illustrates still another configuration example of a pixel circuit and control signals therefor. The main block 275_N−1 in FIG. 17 is a main block of a pixel circuit included in the (N−1)th pixel circuit row. The pixel circuit 270_N is a pixel circuit included in the N-th pixel circuit row and the main block 275_N is the main block of the pixel circuit 270_N.

For the purpose of explanation, the OLED element controlled by the pixel circuit including the main block 275_N−1 is denoted by the reference sign E1_N−1 and the OLED element controlled by the pixel circuit 270_N is denoted by the reference sign E1_N. The OLED element E1_N−1 is included in the (N−1)th pixel circuit row and the OLED element E1_N is included in the N-th pixel circuit row. The main block 275_N−1 and a transistor M13 not shown in FIG. 17 constitute a pixel circuit in the (N−1)th pixel circuit row. The locational relation and the relationship in the circuitry between the main block 275_N−1 and the not-shown transistor M13 are the same as those between the main block 275_N and the transistor M13_N.

The following describes the pixel circuit 270_N. Compared to the pixel circuit 200 in FIG. 2, the connection points of the transistor M17 (an example of the first transistor) and the transistor M13 (an example of the second transistor) are different. In the configuration example of FIG. 2, the transistor M17 is connected between the data line and the transistor M13. In the configuration example of FIG. 17, the transistor M13 is connected between the data line and the transistor M17. Replacing the transistor M17 with the transistor M13 like this example does not change the operation of the pixel circuit.

The transistor M17 in the pixel circuit 270_N for controlling light emission of the light-emitting element E1_N is controlled by the selection signal S_N+1. The transistor M13_N of the pixel circuit 270_N is disposed at a location distant from the other elements of the pixel circuit 270_N. The pixel circuit 270_N consists of the transistor M13_N and the main block 275_N including the other transistors and capacitive elements.

The main blocks in a pixel circuit row to be controlled by the same control lines are disposed in a line along the X-axis, for example, as illustrated in FIG. 5 or 14. A region including the main blocks of a pixel circuit row and not including any elements in the main blocks of another pixel circuit row is referred to as a region of the pixel circuit row (pixel circuit row region). There is a boundary that separates pixel circuit row regions adjacent to each other.

Figure 18:
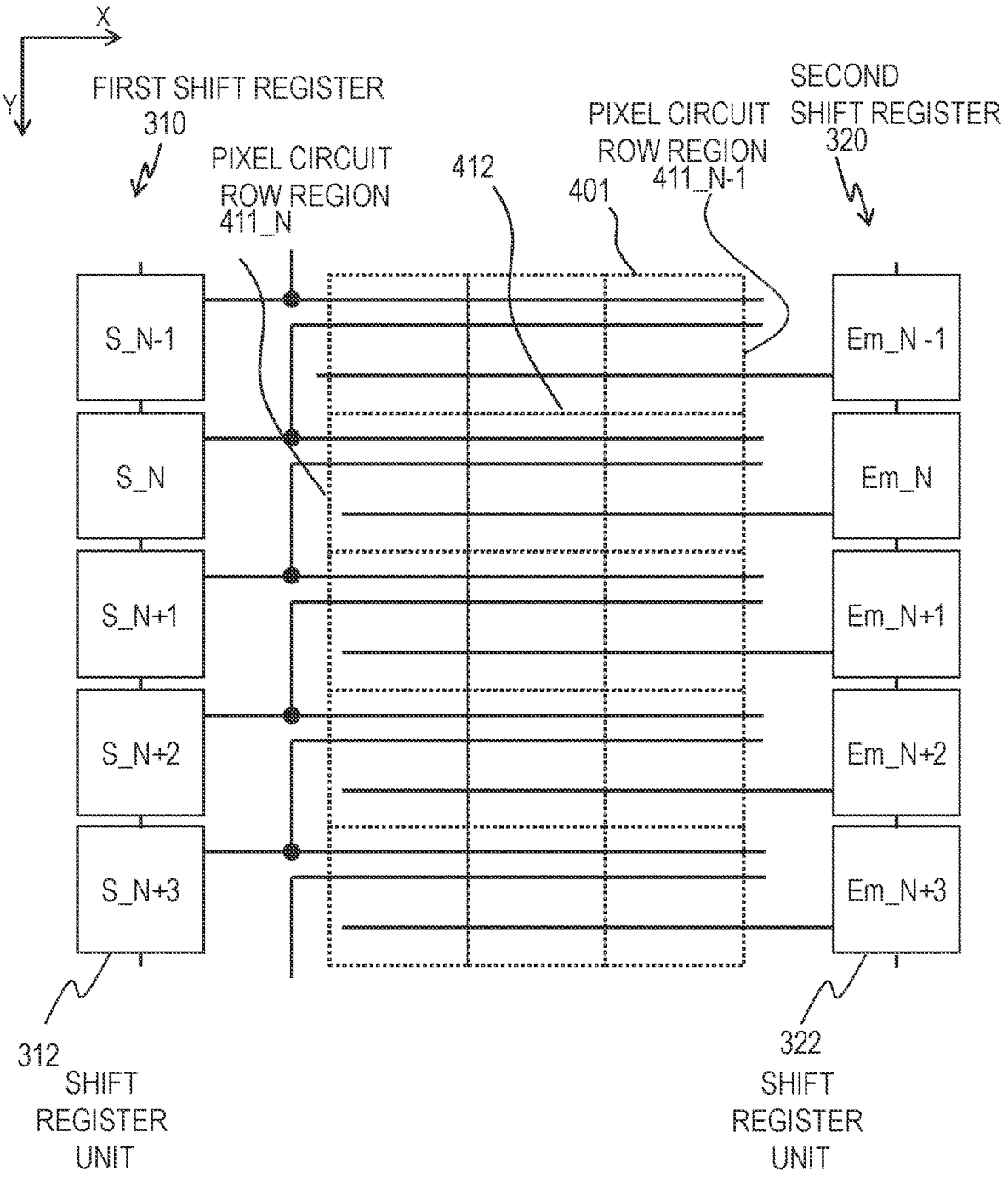
FIG. 18 schematically illustrates a plurality of consecutive pixel circuit row regions.

FIG. 18 schematically illustrates a plurality of consecutive pixel circuit row regions. In FIG. 18, rectangles surrounded by broken lines represent regions including a main block of a pixel circuit and one of such regions including a main block is provided with a reference sign 401. The region 401 can include an element of a pixel circuit different from the pixel circuit the main block belongs to but does not include an element included in another main block. In FIG. 18, the (N−1)th pixel circuit row region is provided with a reference sign 411_N−1 and the N-th pixel circuit row region is provided with a reference sign 411_N. A boundary 412 between the pixel circuit row regions 411_N−1 and 411_N separates these two regions. The pixel circuit row regions in the example of FIG. 18 have the same size (width) along the Y-axis.

Returning to FIG. 17, the transistor M13_N is located within the (N−1)th pixel circuit row region 411_N−1. The other transistors M11 to M16 for controlling the light-emitting element E1_N are located within the N-th pixel circuit row region 411_N. The transistor M13_N is controlled by the emission control signal Em_N−1. For example, a block region 401 of the (N−1)th pixel circuit row region 411_N−1 includes a transistor M13_N, in addition to a main block 275_N−1. A block region 401 of the N-th pixel circuit row region 411_N includes a transistor M13_N+1, in addition to a main block 275_N.

The transistors M13_N and M17 are connected in series between the data line 237 and the storage capacitor consisting of the capacitors C11 and C12. The transistors M13_N and M17 are switch transistors for selecting a pixel circuit to be supplied with a data signal and writing the data signal Vdata to the storage capacitor. The selection signal and the emission control signal vary in the same manner as described with reference to FIG. 3.

As described above, the transistor M13_N is disposed in the (N−1)th pixel circuit row region 411_N−1. The transistor M13_N is controlled by the emission control signal for a pixel circuit row different from the N-th pixel circuit row, in the example of FIG. 17, the emission control signal Em_N−1 for the (N−1)th pixel circuit row. Accordingly, the control lines for controlling the pixel circuit 270_N is reduced to allow an efficient element layout.

Figure 19:
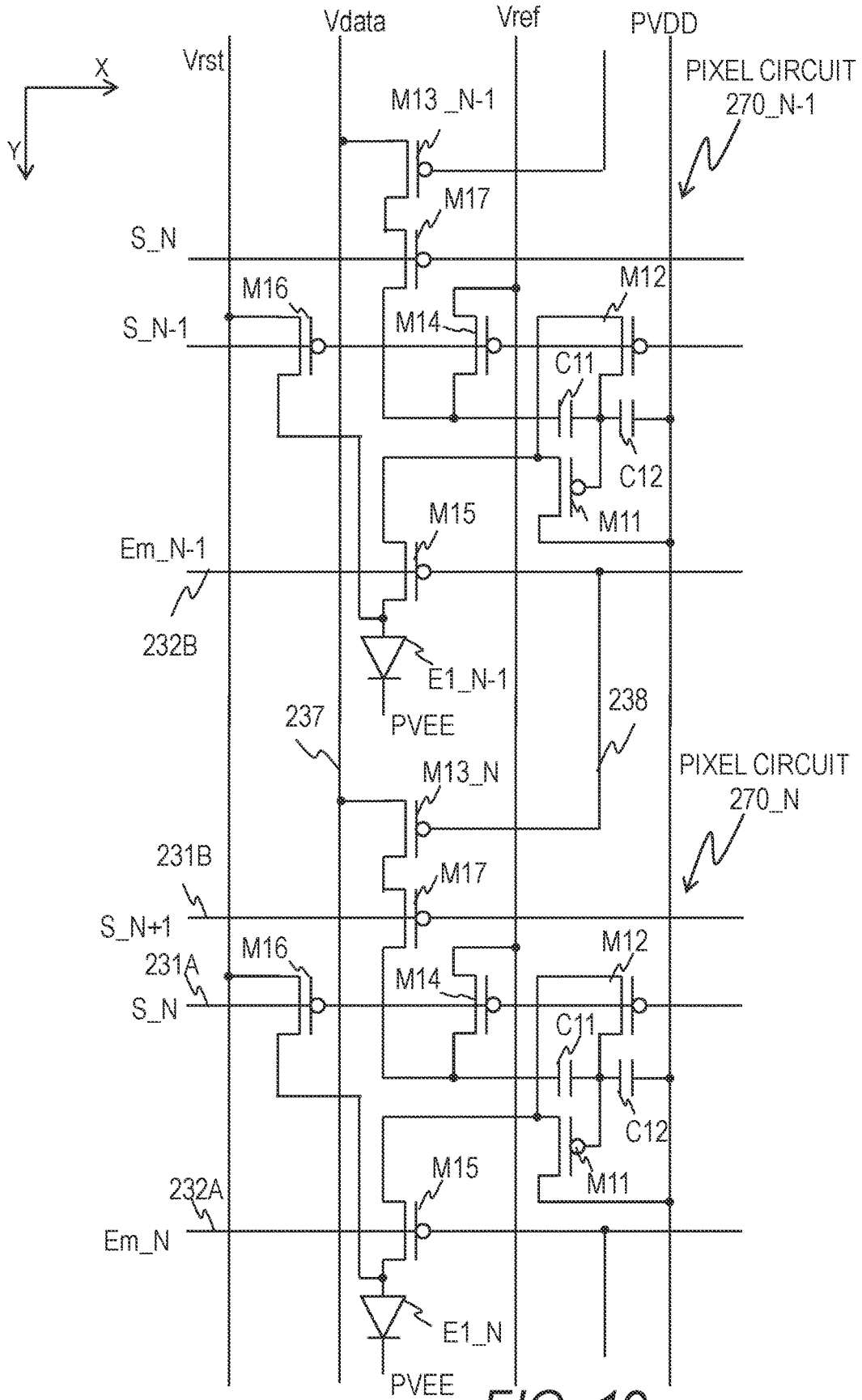
FIG. 19 illustrates still another configuration example of a pixel circuit and control signals therefor.

FIG. 19 illustrates still another configuration example of a pixel circuit and control signals therefor. Differences from the configuration example in FIG. 17 are mainly described. The transistor M13_N−1 is a transistor for controlling light emission of the OLED element E1_N−1.

The transistor M13_N (an example of the second transistor) is disposed in the N-th pixel circuit row region 411_N. In the configuration example of FIG. 19, it can be regarded that the main block includes all elements of a pixel circuit. The gate of the transistor M13_N is connected with a transmission line (control signal line) 238 branched from the control signal line 232B for transmitting the emission control signal Em_N−1 for the (N−1)th pixel circuit row. The control signal line 232B extends through the (N−1)th pixel circuit row region 411_N−1.

The emission control signal Em_N−1 is supplied to the gate of the transistor M13_N via the transmission line 238. As noted from this example, the signal for controlling the transistor M13_N of the pixel circuit of the N-th pixel circuit row is supplied through a transmission line branched from the control signal line provided in a location different from the N-th pixel circuit row region 411_N. Accordingly, the control lines for controlling the pixel circuit 270_N is reduced to allow an efficient element layout.

Although the example in FIGS. 17 and 18 includes the transistor M13_N of the pixel circuit 270_N disposed within the (N−1)th pixel circuit row region 411_N−1, another example can be considered where the transistor M17 of the pixel circuit 270_N is disposed in the (N+1)th pixel circuit row region 411_N+1. Such a configuration can be attained by connecting the transistor M17_N between the transistor M13_N and the data line and disposing the transistor M13_N within the N-th pixel circuit row region 411_N.

Figure 20:
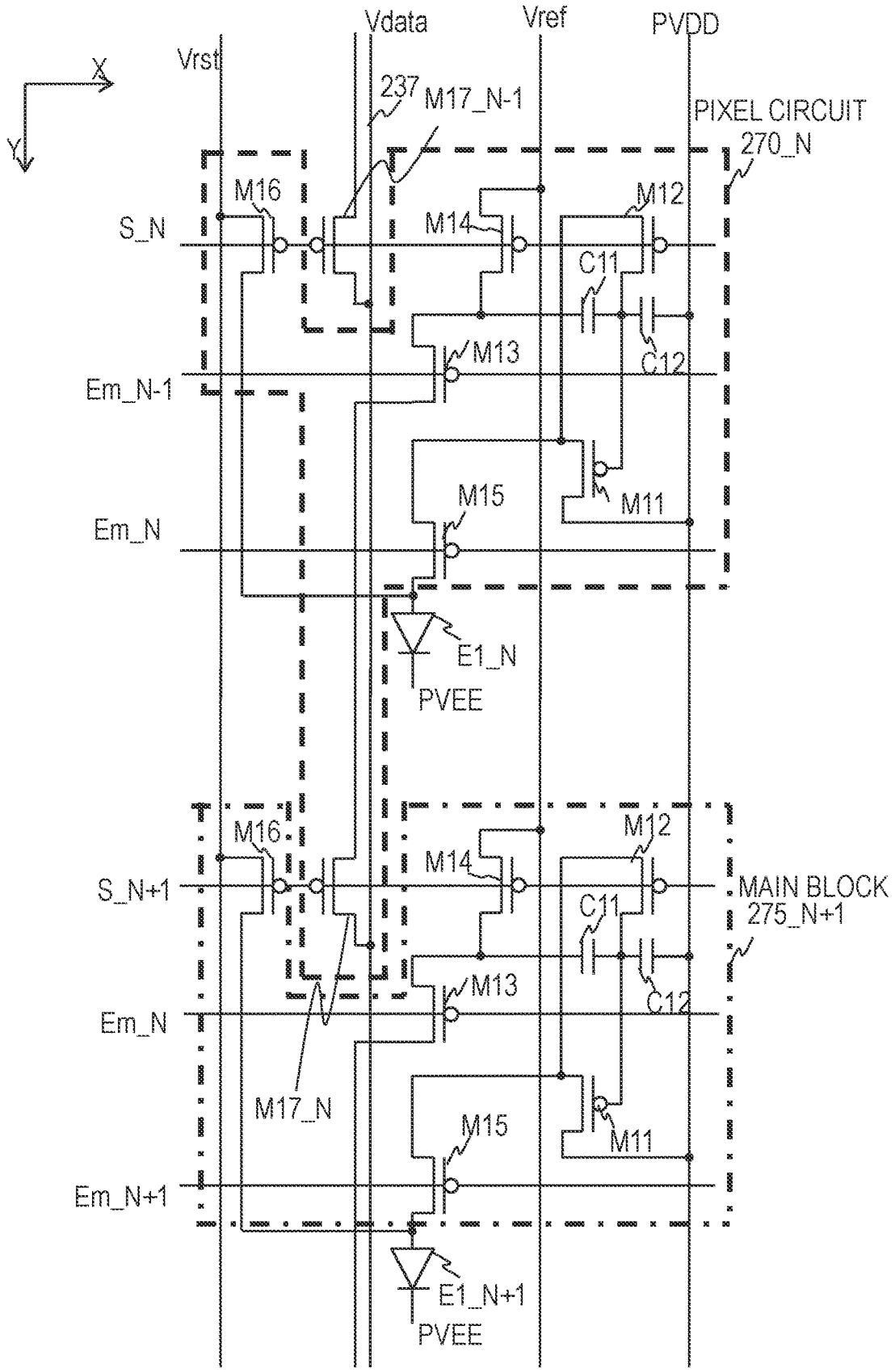
FIG. 20 illustrates still another configuration example of a pixel circuit and control signals therefor.

FIG. 20 illustrates an example of a pixel circuit having this configuration and control signals therefor. Differences from the configuration example in FIG. 17 are mainly described. FIG. 20 illustrates a pixel circuit 270_N in the N-th pixel circuit row and a main block 275_N+1 of a pixel circuit in the (N+1)th pixel circuit row. The transistor M17_N−1 is a transistor included in the (N−1)th pixel circuit row.

The N-th pixel circuit row is controlled with the control signals S_N, Em_N−1, Em_N, and S_N+1. The (N+1)th pixel circuit row is controlled with the control signals S_N+1, Em_N, Em_N+1, and S_N+2 not shown in FIG. 20.

In the pixel circuit 270_N, the connection points of the transistor M13_N (an example of the second transistor) and the transistor M17_N (an example of the first transistor) are replaced compared to the ones in the example of FIG. 17. The transistor M17_N of the pixel circuit 270_N is disposed at a location distant from the other elements of the pixel circuit 270_N.

The main block 275_N+1 consists of transistors M11 to M16 and the capacitors C11 and C12 and does not include the transistor M17 (not shown in FIG. 20). In other words, the main block of the pixel circuit 270_N consists of the elements of the pixel circuit 270_N excluding the transistor M17_N.

Figure 21:
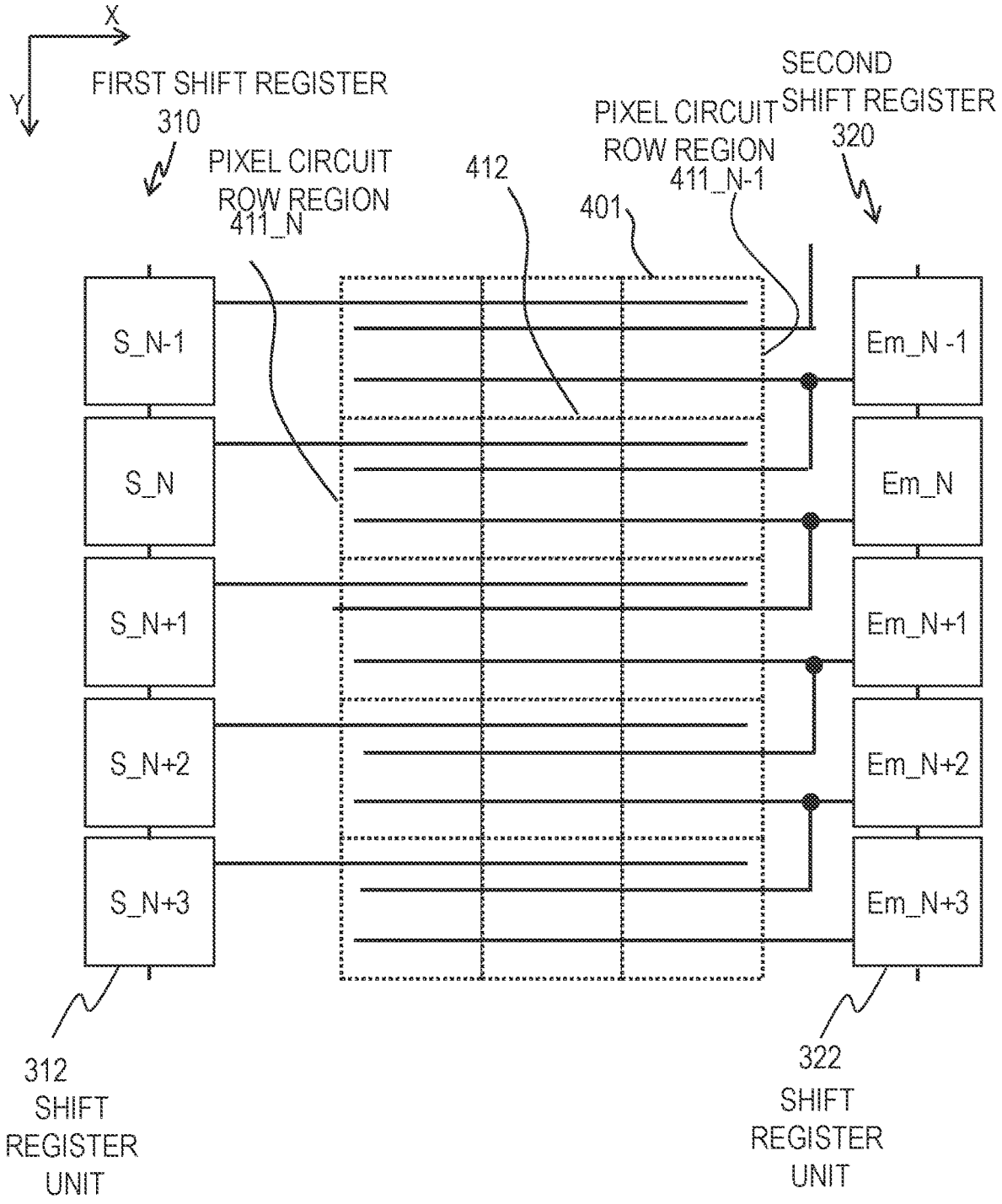
FIG. 21 schematically illustrates a plurality of consecutive pixel circuit row regions.

FIG. 21 schematically illustrates a plurality of consecutive pixel circuit row regions. Differences from FIG. 18 are described. In the configuration example of FIG. 21, a control line from the N-th shift register unit 312, and control lines from the (N−1)th and the N-th shift register units 322 extend through the N-th pixel circuit row region 411_N.

Figure 22:
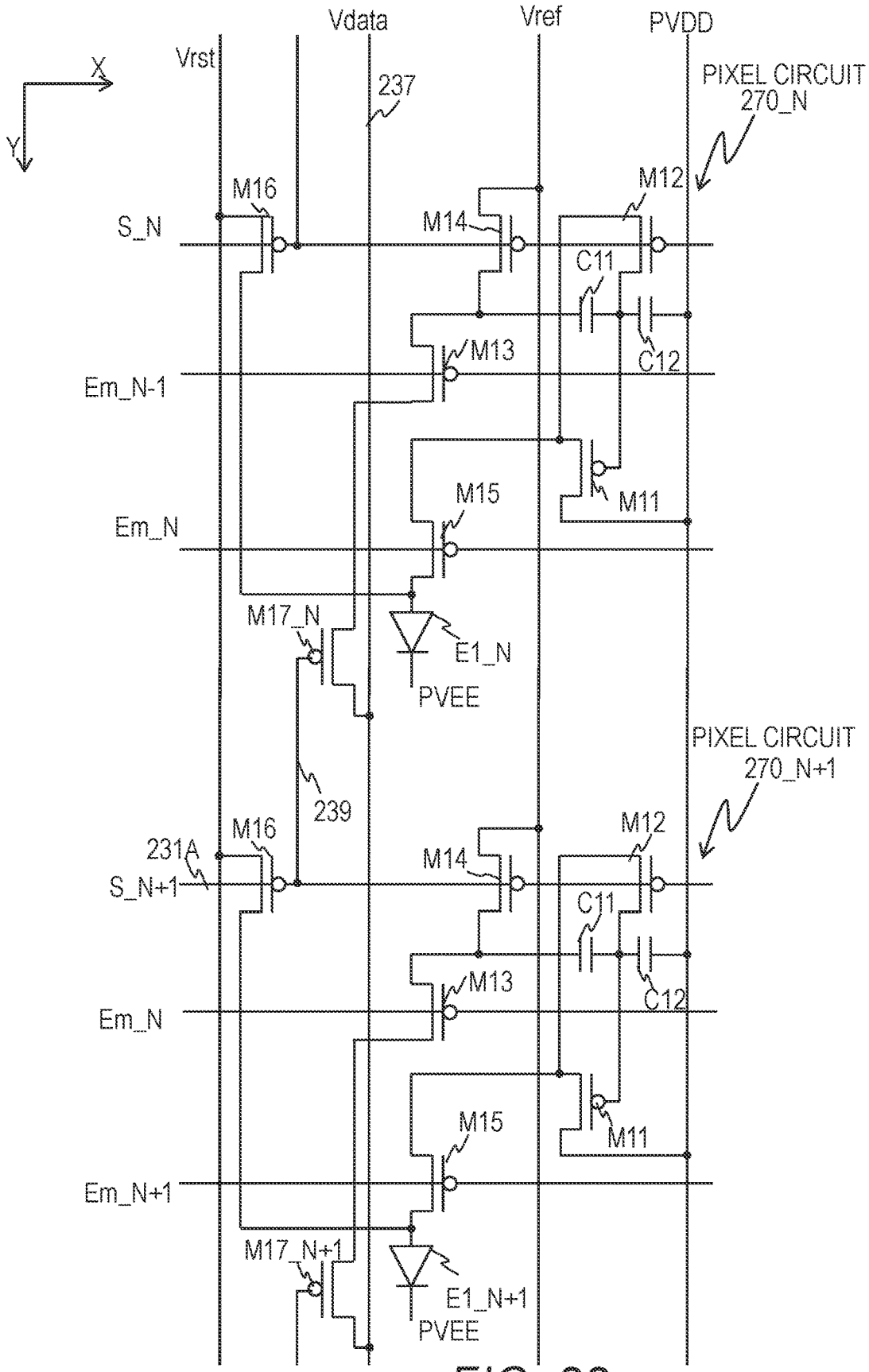
FIG. 22 illustrates still another configuration example of a pixel circuit and control signals therefor.

The transistor M17_N is disposed in the (N+1)th pixel circuit row region 411_N+1. The other transistors M11 to M16 of the pixel circuit 270_N are disposed in the N-th pixel circuit row region 411_N. A block region 401 of the (N+1)th pixel circuit row region 411_N+1 can include a transistor M17_N, in addition to a main block 275_N+1. A block region 401 of the N-th pixel circuit row region 411_N can include a transistor M17_N−1, in addition to a main block 275_N FIG. 22 illustrates a configuration example where the control signal line for the transistor M17, compared with the configuration example of FIG. 19, is lead from the region of an adjacent pixel circuit row. Differences from the configuration example in FIG. 20 are mainly described. The transistor M17_N is disposed within the N-th pixel circuit row region 411_N. It can be regarded that a main block in the configuration example of FIG. 22 includes all elements of the pixel circuit. The gate of the transistor M17_N is connected with a transmission line (control signal line) 239 branched from the control signal line 231A for transmitting the selection signal S_N+1 for the (N+1)th pixel circuit row. The control signal line 231A extends through the (N+1)th pixel circuit row region 411_N+1.

The selection signal S_N+1 is supplied to the gate of the transistor M17_N via the transmission line 239. As noted from this, the signal for controlling the transistor M17_N of a pixel circuit in the N-th pixel circuit row is supplied through a transmission line branched from the control signal line located outside the N-th pixel circuit row region 411_N. Accordingly, the control lines for controlling the pixel circuit 270_N is reduced to allow an efficient element layout.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:

a display region including a plurality of pixel circuit rows; and a driver circuit, wherein each of the plurality of pixel circuit rows includes a plurality of pixel circuits, wherein each of the plurality of pixel circuits includes:

a driving transistor configured to control an amount of electric current to a light-emitting element;

a storage capacitor configured to hold a control voltage for the driving transistor;

a first transistor and a second transistor connected in series, the first and the second transistors being configured to transmit a data signal to the storage capacitor; and a threshold compensation transistor configured to write a threshold compensation voltage for the driving transistor to the storage capacitor, wherein the driver circuit is configured to shift control signal pulses from a row to a next row in the plurality of pixel circuit rows every time a predetermined period passes, wherein a pulse width of the control signal pulses is twice or more as long as the predetermined period, wherein the driver circuit is configured to:

maintain the threshold compensation transistor to be ON to write a threshold compensation voltage to the storage capacitor in a threshold compensation period; and maintain the threshold compensation transistor to be OFF and the first transistor and the second transistor to be ON to write a data signal to the storage capacitor in a data write period subsequent to the threshold compensation period, wherein a pulse width of the control signal pulses is twice or more as long as the data write period, and wherein the driver circuit is configured to:

control the first transistor with a first control signal pulse;

control the second transistor with a second control signal pulse different from the first control signal pulse;

turn ON the first transistor with a start edge of the first control signal pulse before the data write period starts;

maintain the first transistor to be ON and turn ON the second transistor with a start edge of the second control signal pulse to start the data write period after the threshold compensation period ends; and turn OFF the first transistor with an end edge of the first control signal pulse to end the data write period.

2. The display device according to claim 1, wherein the driver circuit is configured to:

supply a reset potential to a gate of the driving transistor during a reset period prior to the threshold compensation period; and maintain the first transistor and the second transistor to be OFF during the reset period.

3. The display device according to claim 2, wherein the driver circuit is configured to turn ON the first transistor with a start edge of the first control signal pulse simultaneously with start of the threshold compensation period.

4. The display device according to claim 1, wherein the driver circuit includes a first driver and a second driver, wherein the first driver is configured to shift control signal pulses having a first polarity from a row to a next row in the plurality of pixel circuit row every time a predetermined period passes, wherein the second driver is configured to shift control signal pulses having a polarity opposite to the first polarity from a row to a next row in the plurality of pixel circuit row every time the predetermined period passes, and wherein the control signal pulses from the first driver are synchronous with the control signal pulses from the second driver.

5. The display device according to claim 4, wherein the driver circuit is configured to control each of the plurality of pixel circuits with two control signal pulses from the first driver and two control signal pulses from the second driver.

6. The display device according to claim 1, wherein the first transistor, the second transistor, and the threshold compensation transistor are n-type thin-film transistors, and wherein the driving transistor is a p-type thin-film transistor.

7. The display device according to claim 6, wherein the threshold compensation transistor is a first threshold compensation transistor, wherein the display device further comprises a second threshold compensation transistor that is an n-type thin-film transistor configured to be controlled with the control signal pulses to control the first threshold compensation transistor, wherein the first threshold compensation transistor is configured to maintain the driving transistor in a diode-connected state when the first threshold compensation transistor is ON, and wherein the second threshold compensation transistor is configured to supply a reference potential to the storage capacitor when the second threshold compensation transistor is ON.

8. The display device according to claim 1, wherein the first control signal pulse or the second control signal pulse to control the N-th pixel circuit row is configured to control the first transistor or the second transistor through a transmission line branched from a control signal line extending in a region different from a pixel circuit row region for the N-th pixel circuit row.

9. The display device according to claim 8, wherein the transmission line is branched from a control signal line extending through a pixel circuit row region adjacent to the pixel circuit row region for the N-th pixel circuit row.

10. The display device according to claim 1, wherein the pulse width of the control signal pulses is three times or more as long as the data write period, and wherein the threshold compensation period is twice or more as long as the data write period.

11. The display device according to claim 1, further comprising:

an emission control switch transistor configured to switch ON/OFF supply of driving current from the driving transistor to the light-emitting element, wherein the driver circuit is configured to:

maintain the emission control switch transistor to be OFF in the threshold compensation period and the data write period; and turn ON the emission control switch transistor after the data write periods ends.

12. The display device according to claim 1, wherein the driver circuit is configured to turn OFF the second transistor with an end edge of the second control signal pulse in a period where the light-emitting element is emitting light.

13. The display device according to claim 1, wherein the first transistor or the second transistor of a pixel circuit in the N-th pixel circuit row is disposed within a pixel circuit row region different from a pixel circuit row region for the N-th pixel circuit row.

* * * * *